US010600319B1

(12) United States Patent
Shuff

(10) Patent No.: US 10,600,319 B1
(45) Date of Patent: Mar. 24, 2020

(54) ADAPTIVE TRAFFIC SIGNAL

(71) Applicant: Greg Douglas Shuff, Henderson, NV (US)

(72) Inventor: Greg Douglas Shuff, Henderson, NV (US)

( * ) Notice: Subject to any disclaimer, the term of this patent is extended or adjusted under 35 U.S.C. 154(b) by 0 days.

(21) Appl. No.: 16/367,198

(22) Filed: Mar. 27, 2019

(51) Int. Cl.

| | |
|---|---|
| ***G08G 1/005*** | (2006.01) |
| ***G08G 1/08*** | (2006.01) |
| ***G08G 1/01*** | (2006.01) |
| ***G08G 1/052*** | (2006.01) |

(52) U.S. Cl.
CPC ..... *G08G 1/08* (2013.01); *G08G 1/0116* (2013.01); *G08G 1/052* (2013.01)

(58) Field of Classification Search
CPC . G08G 1/005; G08G 1/07; G08G 1/08; G01S 13/92
See application file for complete search history.

(56) References Cited

U.S. PATENT DOCUMENTS 5,929,787 A * 7/1999 Mee ..... G08G 1/07 340/683
6,281,808 B1 * 8/2001 Glier ..... G07B 15/06 340/916
2005/0046597 A1 * 3/2005 Hutchison ..... G01S 13/92 340/917
2005/0138488 A1 * 6/2005 Jacobs ..... G08G 1/097 714/56
2006/0142933 A1 * 6/2006 Feng ..... G07B 15/063 701/117
2006/0181433 A1 * 8/2006 Wolterman ..... G08G 1/08 340/917
2009/0146841 A1 * 6/2009 Basson ..... G08G 1/005 340/925
2013/0285840 A1 * 10/2013 Allen ..... G08G 1/07 340/923
2015/0154860 A1 * 6/2015 Holzwanger ..... G08G 1/0967 340/944
2015/0154863 A1 * 6/2015 Fossier ..... G09F 9/33 340/907
2016/0148507 A1 * 5/2016 Pittman ..... H04W 4/029 340/917

* cited by examiner

*Primary Examiner* — Munear T Akki
(74) *Attorney, Agent, or Firm* — Bayramoglu Law Offices LLC

(57) ABSTRACT

An adaptive traffic signal including a traffic signal plate and at least one signal light indicator controlled by a traffic signal control system (TSCS) and connected to a traffic flow sensor system (TFSS). In an active mode, the adaptive traffic signals TFSS senses vehicle presence, speed, location and other parameters, communicates this data to the TSCS. The adaptive traffic signal works as a traffic control signal and the TSCS switches on the at least one light indicator according to a traffic control signal sequence. In an inactive mode, the adaptive traffic signal's TSCS switches off at least one light indicator and switches on at least one flashing red light indicator and the adaptive traffic signal works as a stop indicator for all intersection traffic directions.

31 Claims, 19 Drawing Sheets

ADAPTIVE TRAFFIC SIGNAL

TECHNICAL FIELD

The present invention relates to traffic signal devices and more particularly to an adaptive traffic signal for directing vehicles to stop or move on the road, through an intersection and an intersection traffic control system implementing the adaptive traffic signal.

BACKGROUND

A traffic signal is a traffic device used to control traffic at intersections by notifying drivers how they may proceed through intersections. Generally, traffic signals employ red, green and yellow light indicators to notify the drivers that if they may proceed through the intersection without stopping or if they must come to a complete stop and wait for a traffic signal to change to "Green" and intersection cross traffic to clear before proceeding. Generally, the traffic signal is not intended for use as a traffic calming device; it is intended to be installed mainly for safety and to assign right-of way for a certain direction. Traffic signals are commonly deployed as control and safety measures in areas with moderate to high levels of traffic in all directions. Traffic signals are usually erected on all intersecting roads, resulting in three-way or four-way traffic signals. A driver is supposed to observe traffic signal status and either proceed through the intersection with a green light, transition or begin to brake for a yellow light or stop at the intersection threshold with a Red Light and wait for a Green Light and clear intersection to proceed.

Presently, Autonomous Vehicles or vehicles that drive themselves are being tested and are in limited production. In the future, these autonomous vehicles will take over our highways. Advanced Sensors, Artificial Intelligence, Neural Networks, Deep Learning and Advanced Communications Links make all this possible. Vehicles are being provided with the latest computer and sensor technology that allows them to drive themselves. The currently available traffic signals are not designed for upcoming autonomous vehicles or self-driven vehicles. As in self-driven vehicles, the vehicle is not driven by humans, these vehicles cannot rely on the human judgment to follow traffic rules at traffic signals. To make a self-driven vehicle intelligent enough to deal with traffic signals will add significant complexity to self-driven vehicles, requiring complex hardware and software support. Further, the chances of an accident may increase, as each vehicle may behave differently based on the hardware and software employed within the vehicle.

The Federal Highway Administration reports approximately 2.5 Million intersection accidents every year. Intersection accidents represent 40% of all accidents nationally are led only by rear end collisions. Most intersection accidents involve left turns. Fifty percent of serious accidents happen in intersections and approximately 20% of fatal accidents occur there. Red Light runners are responsible for approximately 165,000 accidents that occur annually. As autonomous vehicles are introduced into the highway system and are becoming increasingly popular, a decrease in accidents at intersections is anticipated as driver and driverless vehicles navigate the highways. It may take 30-50 years or more for autonomous vehicles to completely take over our highways and until that time, driver and driverless vehicles will share our streets and highways, presenting new challenges for traffic control and safety at intersections.

SUMMARY

Various embodiments provide an adaptive traffic signal and an intersection traffic control system made using the adaptive traffic signal thereof.

In one of the embodiments, an adaptive traffic signal includes a traffic signal plate and at least one light indicator. The traffic signal plate is divided into a plurality of sections including a top section having at least one red light indicator, a center section having at least one yellow light indicator, and a bottom section having at least one green light indicator. A traffic flow sensor system (TFSS) module is located on a rear side of the traffic signal plate. A plurality of sensor holes or ports are provided in the traffic signal plate for sensor detection of the presence of an oncoming vehicle, a speed of the vehicle, an acceleration or deceleration of the vehicle, a heading direction of the vehicle, a location of the vehicle, a turn signal status of the vehicle, a type of the vehicle, a size of the vehicle and a registration number of the vehicle in a traffic lane. The adaptive traffic signal further includes a traffic signal control system (TSCS). In an active mode, the adaptive traffic signal works as a traffic control signal and the TSCS switches on at least one light indicator selected from the group consisting of the at least one red light indicator, the at least one yellow light indicator and the at least one green light indicator, according to a traffic control signal light schedule. In an inactive mode, the adaptive traffic signal switches off the at least one light indicator and switches on at least one flashing light indicator. The TFSS is used to enhance a TSCS traffic control signal light timing and schedule of the adaptive traffic signal.

Preferably, in the inactive mode the TSCS switches off the at least one red light indicator, the at least one yellow light indicator, and the at least one green light indicator, and switches on at least one flashing red light indicator.

Preferably, in a condition of malfunctioning of the adaptive traffic signal, the TSCS switches the adaptive traffic signal to work in the inactive mode, and transmits a malfunction code to a traffic control signal monitoring center for resolution.

Preferably, the at least one red light indicator includes a plurality of red light emitting diode (LED) lights, the at least one yellow light indicator includes a plurality of yellow LED lights and the at least one green light indicator includes a plurality of green LED lights. The plurality of red LED lights, the plurality of yellow LED lights and the plurality of green LED lights are circular, square, rectangular or extended rectangular in shape.

Preferably, each light indicator includes a plurality of signal light indicator zones, each signal light indicator zone includes at least one row of LED lights and each row of LED lights includes a plurality of LED lights. Each signal light indicator zone is configured to be switched on and off independently from other signal light indicator zones by the TSCS. The TSCS receives data from the TFSS and switches on or off the plurality of signal light indicator zones according to time of day or night, weather conditions and/or traffic conditions.

Preferably, during daylight hours all zones would be "ON", during evening hours with less traffic as detected by the TFSS, the outer zone would be turned "OFF" and during late night hours with minimal traffic as detected by the TFSS, only the center zone would be "ON", thus providing a traffic signal that adapts to the operating time, weather condition and traffic flow of the day. Additionally, independent circuit or zone control may be implemented during daylight hours when the TFSS detects no traffic in a direction. With no traffic detected, outer row circuits or zones would be turned "OFF" for that direction until the TFSS detects traffic or vehicle presence, then outer zones turned back "ON". All adaptive traffic signal lights would have zones. Multiple independent circuit LED light switching in this manner adapts to the time of day, weather conditions and traffic to increase reliability with multiple zones, and to conserve power and associated costs for intersections where implemented.

Preferably, the adaptive traffic signal further includes an intelligent Signal Light Monitoring System (SLMS) having a camera and a processor module mounted above the traffic signal plate to continuously monitor the red LED lights, the yellow LED lights and the green LED lights and the plurality of light indicator zones provided in the top section, the center section and the bottom section respectively for signal lighting malfunction or timing malfunction. In case of detecting a lighting malfunction or a timing malfunction, the SLMS sends a malfunctioning signal indicating a condition of malfunctioning of the adaptive traffic signal to the TSCS, and in-turn transmits a malfunction code to a traffic control signal monitoring center for resolution.

Preferably, the adaptive traffic signal further includes a support pole and a cross arm pole. The adaptive traffic signal is mounted on the support pole and/or the cross arm pole. The electrical power wiring, traffic signal control wiring, sensor wiring and SLMS wiring are enclosed within the support pole and the cross arm pole.

Preferably, the plurality of red LED lights, the plurality of yellow LED lights and the plurality of green LED lights are provided in form of LED light strips with narrow angle patterns of light distribution with a concentration of light power directly in a front direction of the adaptive traffic signal, and vary in brightness in accordance with sunlight. The LED light strips are clearly visible from a distance of at least 800 feet.

Preferably, each LED light strip includes a flexible plastic material affixed with LED lights. The flexible plastic material, containing the LED lights are colored or painted to match a traffic signal plate background color. The red LED light strips, the yellow LED light strips and the green LED light strips are provided in circular, square, rectangular or extended rectangular shapes.

Preferably, the at least one red light indicator is a red LED light module affixed on the top section, the at least one yellow indicator is a yellow LED light module affixed on the center section, and the at least one green light indicator is a green LED light module affixed on the bottom section. The red LED light module, the yellow LED light module and the green LED light module are circular, square, rectangular or extended rectangular in shape.

Preferably, the adaptive traffic signal further includes an Organic light emitting diode (OLED) flat panel display affixed on the traffic signal plate such that when the OLED flat panel display is in an active state, the OLED display works as a traffic control signal light. Preferably, to display a red light of the traffic control signal corresponding to a stop signal, a top part of the OLED display covering the top section is activated to display red color, a center part of the OLED display covering the center section and a bottom part of the OLED display covering the bottom section are activated to display black or gray color. To display a yellow light of the traffic control signal corresponding to a ready to stop signal, the center part of the OLED display covering the center section is activated to display yellow color, the top part of the OLED display covering the top section and the bottom part of the OLED display covering the bottom section are activated to display black or gray color. To display a green light of the traffic control signal corresponding to a go signal, the bottom part covering the bottom section is activated to display green color, the top part of the OLED display covering the top section and the center part of the OLED display covering the center section are activated to display black or gray color. The OLED flat panel display has narrow angle patterns of light distribution with a concentration of light power directly in a front direction of the adaptive traffic signal, and vary in brightness in accordance with sunlight. The OLED display is clearly visible from a distance of at least 800 feet. The OLED flat panel display goes into an inactive state when the adaptive traffic signal is in the inactive mode.

Preferably, the adaptive traffic signal further includes an LEDTV flat panel array affixed to the traffic signal plate such that when the LEDTV flat panel array is in an active state, the LEDTV array works as a traffic control signal light. Preferably, to display a red light of the traffic control signal corresponding to a stop signal, a top part of the LEDTV array covering the top section is activated to display red color, a center part of the LEDTV array covering the center section and a bottom part of the LEDTV array covering the bottom section are un-activated or activated to display black or gray color. To display a yellow light of the traffic control signal corresponding to a ready to stop signal, the center part of the LEDTV array covering the center section is activated to display yellow color, the top part of the LEDTV array covering the top section and the bottom part of the LEDTV array covering the bottom section are un-activated or activated to display black or gray color. To display a green light of the traffic control signal corresponding to a go signal, the bottom part of the LEDTV array covering the bottom section is activated to display green color, the top part of the LEDTV array covering the top section and the center part of the LEDTV array covering the center section are un-activated or activated to display black or gray color. The LEDTV flat panel array has narrow angle patterns of light distribution with a concentration of light power directly in a front direction of the adaptive traffic signal, and vary in brightness in accordance with sunlight. The LEDTV array is clearly visible from a distance of at least 800 feet. The LEDTV red light, yellow light and green light portions of the array are circular, square, rectangular or extended rectangular in shape. The LEDTV array goes into an inactive state when the adaptive traffic signal is in the inactive mode.

Preferably, the adaptive traffic signal may further include a solar panel installed on a solar panel plate above the adaptive traffic signal and/or the adaptive traffic signal's support pole and/or cross arm. The solar panel provides the electric power for all devices mounted on the adaptive traffic signal to include: the plurality of LED lights, or the OLED transparent flat panel display or the LEDTV array; the TFSS; the SLIM; and the TSCS.

Preferably, the adaptive traffic signal may further include a Battery Pack installed in close proximity to the Solar Panel where excess power will recharge the Battery Pack. The Battery Pack sufficiently sized to provide power to the adaptive traffic signal and all devices for a minimum of 36 hours in the event of solar panel malfunction or cloud coverage. The TSCS monitors the Solar panel and Battery Pack status and in the event of malfunction of the solar panel or battery pack the TSCS will forward a malfunctioning code to the central traffic control monitoring center for resolution.

Preferably, the TSCS is attached to a rear of the traffic signal plate and the TSCS activates the plurality of LED lights and the plurality of light indicator zones in a predetermined sequence or phase and time to control traffic flow through an intersection. The TSCS includes two independent hardware platforms, each independent hardware platform has a CPU (Central Processing Unit) and a time clock to determine the time and sequence of the LED lights, changing from GREEN to YELLOW to RED, and then to GREEN to continue a cycle. The two independent hardware platforms include a first independent hardware platform working as a main controlling unit and a second independent platform working as a backup control unit. In case of a failure of the first independent hardware platform, the second independent hardware platform starts working as the main control unit, and a malfunction signal code is forwarded to a central traffic control monitoring center for resolution.

Preferably, the TSCS is configured to communicate with a central traffic network, a central traffic control monitoring center, emergency vehicles, autonomous and semi-autonomous vehicles. The communication is at least one selected from the group consisting of a Bluetooth communication, a LoRa communication, an internet communication, a cell phone network communication, an independent intranet network communication, an RF communication, a wired communication, and an optic fiber communication. Preferably, TSCS data and parameters communicated are in a coded format, where, signal codes communicated to autonomous and semi-autonomous vehicles include a signal light status, a countdown time to signal change, a distance to stop on yellow signal light to prevent red light jumping. Malfunction codes are communicated to central traffic control monitoring centers for resolution.

Preferably, the traffic flow sensor system (TFSS) module is located on the rear of the traffic signal plate in close proximity and integrated into the TSCS to enhance the signal timing by detecting the presence of the vehicles, the speed of the vehicles, the acceleration/deceleration of the vehicles, the heading direction of the vehicles, the location of the vehicles, the turn signal status of the vehicles, the type of the vehicles, the size of the vehicles and the number of the vehicles in a traffic lane. The TFSS module is integrated with the TSCS by hard wire or via a wireless communication link.

Preferably, the TFSS module includes a plurality of sensors including a first EO (visual electro optical) or IR (infrared) camera for detecting vehicle data including the presence of the vehicles, the location of the vehicles, the turn signal status of the vehicles, the type of the vehicles, the size of the vehicles and the number of the vehicles in a traffic lane. The TSCS uses the vehicle data to dynamically control the traffic signal sequence and timing.

Preferably, the TFSS module further includes a second camera. The first camera and the second camera are focused on a same space to provide a three-dimensional sensing of the vehicles to determine a part of the vehicle data including the speed of the vehicles, the acceleration/deceleration of the vehicles, the heading direction of the vehicles and an estimated time each vehicle will take to reach the intersection; the second camera is an EO or an 1R camera.

Preferably, the first camera and the second camera should be aligned and calibrated at the manufacturing facility or factory with the ability to easily adjust the cameras view at the intersection location. The camera pair should be adjusted to view the desired intersection scene or highway lanes at the time of installation and not require camera to camera alignment during installation. Cameras should have the same lens and field of view specifications for all electro-optical (EO) and infrared (IR) camera combinations.

Preferably, the TFSS module further includes a radar for detecting the vehicle data including the presence of the vehicles, the speed of the vehicles, the location of the vehicles, and the estimated time each vehicle will take to reach the intersection.

Preferably, the TFSS module further includes a lidar for detecting the vehicle data including the presence of the vehicles, the speed of the vehicles, the location of the vehicles, the size of the vehicles, and the estimated time each vehicle will take to reach the intersection.

Preferably, the TFSS module further includes environmental sensors to detect a weather condition data including temperature, humidity, wind speed, rain, snow, ice, fog and dust. The TSCS uses the weather condition data in combination with traffic flow data to control the sequence and timing of the plurality of LED lights.

Preferably, the adaptive traffic signal further includes a plurality of pedestrian signs provided on sides of the support pole. The TSCS controls the plurality of pedestrian signals in synchronization with the traffic control signal.

Preferably, the adaptive traffic signal also includes a microphone that is either freestanding or integrated with the intelligent adaptive traffic signal light monitoring system/camera (SLMS). The microphone can detect useful information (e.g. traffic horns, wheel sketching, vehicle collisions, etc.) and relay that information to the SLMS and TSCS and in-turn transmit select sounds to a central traffic control monitoring center for resolution.

Preferably, the plurality of LED lights or LED light strips may be hi-bright white in color LED lights enclosed with a color filter and/or diffuser. The color filter/diffuser may consist of glass or plastic material and filter the Red, Yellow and Green color from the hi-bright white LED lights appropriately positioned on the traffic signal plate.

Preferably, the color filter/diffuser may further diffuse the light so that each separate signal light appears as one consistently colored signal light and does not appear as a plurality of lights.

Preferably, the adaptive traffic signal may further include an OLED flat panel display or LEDTV array configured as a light bar, where the entire surface of the light signal display/array displays a red color, or a yellow color or a green color. The OLED or LEDTV light bar would further display a separate traffic light signal position, top—red, center—yellow and bottom—green on one side of the light bar as in standard traffic signals for color blind individuals to easily recognize. The other side of the OLED or LEDTV light bar may display a traffic signal sequence or phase countdown timer and wireless communication link to advise autonomous vehicles, vehicles, drivers and pedestrians of the up and coming signal change to reduce intersection red light runners.

Preferably, in the inactive mode the OLED flat panel display or LEDTV array reverts to displaying a flashing red light of the traffic control signal corresponding to a stop signal. A top part of the OLED display or LEDTV array covering the top section is activated to display a flashing red color, a center part and bottom part of the OLED display or LEDTV array covering the center and bottom sections are activated to display black or gray color.

Preferably, the adaptive traffic signal may further include a sun/privacy screen that protects the light indicators from direct sunlight. Additionally, the sun/privacy screen allows one direction of traffic to view the light indicator status, and light indicators are screened (not visible) from other directions. The sun/privacy screen may be circular, square, rectangular, or extended rectangular in shape. If the sun/privacy screen is extended rectangular in shape, it may also include egg crate type inserts due to the length of the extended LED light indicators to provide shade and to protect the light indicators from direct sunlight and to insure visibility from only one direction.

In one of the embodiment, the intersection traffic control system includes a plurality of adaptive traffic signals installed at an intersection. Each adaptive traffic signal includes a traffic signal plate and at least one light indicator. The traffic signal plate is divided into a plurality of sections. The adaptive traffic signal includes a traffic signal control system (TSCS). In an active mode, the adaptive traffic signal works as a traffic control signal and the TSCS switches on the at least one light indicator according to a traffic control signal. In an inactive mode, the TSCS switches off the at least one light indicator and switches on at least one flashing red light indicator for all intersection adaptive traffic signals and acts as a "Stop" signal for all intersection directions. The TSCS of one of the adaptive traffic signals works as a master TSCS for the intersection traffic control system and the TSCS of the other adaptive traffic signals works as slave TSCS's for the intersection traffic control system. All the TSCSs include a Master/Slave switch allowing the master TSCS to control the timing of the light indicators for the plurality of adaptive traffic signals. Each TSCS includes a transmitter and a receiver. The master TSCS transmits a signal code to implement a change of signal to the slave TSCSs and the slave TSCSs transmits confirmation signal codes to the master TSCS to acknowledge and verify a light change. The TSCSs also transmits a separate signal code to autonomous vehicles so that they implement appropriate actions.

Preferably, the traffic signal plate is divided into a top section, a center section and a bottom section. The top section is provided with at least one red light indicator. The center section is provided with at least one yellow light indicator. The bottom section is provided with at least one green light indicator. In the inactive mode the TSCS switches on the at least one flashing red light indicator, and switches off the at least one yellow light indicator, and the at least one green light indicator.

Preferably, in the OLED flat panel display or LED flat panel TV (LEDTV) array embodiment, in the inactive mode the TSCS switches off the at least one red light indicator, and the at least one yellow light indicator, and the at least one green light indicator, and switches on the at least one flashing red light indicator.

Preferably, in a condition of malfunctioning of the adaptive traffic signal, the TSCS switches the adaptive traffic signal to work in the inactive mode and transmit a malfunctioning code to the central traffic control monitoring center for resolution.

Preferably, the master TSCS has a programming capability for all aspects of the intersection traffic control system including signal light timings, signal light zones, flashing/blinking lights, and hours of operation.

Preferably, in case the master TSCS does not receive the confirmation signal codes from the slave TSCS or receives a slave TSCS malfunction signal code, the master TSCS initiates a shut-down sequence, sending the plurality of adaptive traffic signals to work in the inactive mode.

Preferably, the at least one red light indicator includes a plurality of red light emitting diode (LED) lights, the at least one yellow light indicator includes a plurality of yellow LED lights and the at least one green light indicator includes a plurality of green LED lights respectively.

Preferably, the intersection traffic control system may further include a remote control unit for testing and verifying operations of the intersection control system remotely, and to remotely and manually control the lights by police or emergency vehicles and/or personnel.

Preferably, the TSCS is configured to communicate with other intersections, a central traffic network, a central traffic control monitoring center, emergency vehicles, and autonomous vehicles. The communication is at least one selected from the group consisting of a Bluetooth communication, a LoRa communication, a Wi-Fi communication, a cell phone network communication, an independent intranet network communication, an RF communication, a wired communication, and an optic fiber communication Preferably, the Adaptive Traffic Signal adapts to intersection traffic flow in all directions and is capable of adapting with respect to parameters including vehicle size, vehicle type, vehicle location, vehicle speed/acceleration/deceleration and estimated threshold time). The adaptive traffic signal is adapted to hold on "Yellow" signal light until intersection is cleared. The Adaptive Traffic Signal is capable of adapting with respect to Intersection incidents like accidents, stalls, situations to inhibit traffic flow in and around intersections, surrounding intersection communication (surrounding intersections provide signal status so that the intersection will have a heads up on when to expect heavy traffic and change signal accordingly). Preferably, the adaptive traffic signal may detect an Emergency vehicle and change the traffic signals accordingly. The adaptive traffic signal is adapted for autonomous vehicle communication (to advise autonomous vehicles of signal status, change of signal, and countdown to change of signal status); and, Time of Day/night change of individual signal light zones (to conserve power particularly for solar powered adaptive traffic signals).

Preferably, the Adaptive Traffic Signal may decrease traffic controlled intersection accidents by providing increased driver's visual traffic signal experience at intersections with increased traffic light size, illumination and sequence (phase) timing countdown to signal change; Increase traffic signal control phase (Green, Yellow, Red, Delay) timing by detecting vehicle, non-vehicle & pedestrian presence, position, speed, type, size and behavior during daylight/nighttime or rush hours and under varying roadway & weather conditions; Increase intersection traffic throughput by communicating and coordinating with adjacent intersections, roadway (infrastructure) local & remote sensors and automated or autonomous vehicles and vehicle sensors; and, advise vehicle operators (drivers) though on-board vehicle displays and annunciation, where autonomous vehicles may respond automatically.

BRIEF DESCRIPTION OF THE DRAWINGS

For a better understanding of the invention and to show how it may be performed, embodiments thereof will now be described, by way of non-limiting example only, with reference to the accompanying drawings, in which.

DETAILED DESCRIPTION

Figure 1C:
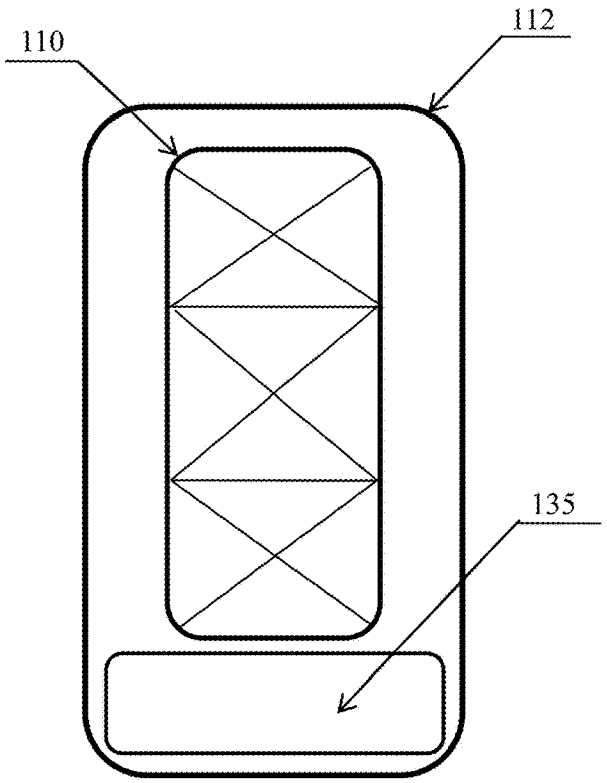
FIG. 1C shows the rear view of an adaptive traffic signal, traffic signal plate, traffic signal shield, and traffic flow sensor system (TFSS) in the embodiment.

Referring to FIGS. 1-19, adaptive traffic signal 100 includes traffic signal plate 110 and at least one light indicator 120, 124, 128. The traffic signal plate 110 is divided into a plurality of sections including a top section having at least one red light indicator 120, a center section having at least one yellow light indicator 124, and a bottom section having at least one green light indicator 128. A traffic flow sensor system (TFSS) module 135 is located on a rear side of the traffic signal plate 110. A plurality of sensor holes or ports 130, 132 are provided in the traffic signal plate for sensor detection of the presence of an oncoming vehicle, a speed of the vehicle, an acceleration or deceleration of the vehicle, a heading direction of the vehicle, a location of the vehicle, a turn signal status of the vehicle, a type of the vehicle, a size of the vehicle and a registration number of the vehicle in a traffic lane. The adaptive traffic signal 100 further includes a traffic signal control system (TSCS) 1738. In an active mode, the adaptive traffic signal 100 works as a traffic control signal and the TSCS switches on at least one light indicator selected from the group consisting of the at least one red light indicator 120, the at least one yellow light indicator 124 and the at least one green light indicator 128, according to a traffic control signal light schedule. In an inactive mode, the adaptive traffic signal switches off the at least one light indicator and switches on at least one flashing light indicator. The TFSS 135 is integrated with the TSCS 1738 by a hardwire or via a wireless communication link and data derived from the TFSS 135 is used to enhance a TSCS traffic control signal light timing and schedule of the adaptive traffic signal.

In the inactive mode the TSCS 1738 switches off the at least one red light indicator 120, the at least one yellow light indicator 124, and the at least one green light indicator 128, and switches on at least one flashing red light indicator. Alternatively, instead of providing a separate flashing red light indicator, the TSCS makes the at least one red light indicator 120 to flash.

In a condition of malfunctioning of the adaptive traffic signal 100, the TSCS 1738 switches the adaptive traffic signal 100 to work in the inactive mode, and transmits a malfunction code to a traffic control signal monitoring center for resolution.

In another embodiment, the at least one red light indicator 120 includes a plurality of red light emitting diode (LED) lights, the at least one yellow light indicator includes 124 a plurality of yellow LED lights and the at least one green light indicator 128 includes a plurality of green LED lights. The plurality of red LED lights, the plurality of yellow LED lights and the plurality of green LED lights are circular, square, rectangular or extended rectangular in shape.

Each light indicator includes a plurality of signal light indicator zones 344, 345, 346. Each signal light indicator zone includes at least one row of LED lights and each row of LED lights includes a plurality of LED lights. Each signal light indicator zone is configured to be switched on and off independently from other signal light indicator zones by the TSCS 1738. The TSCS 1738 receives data from the TFSS 135 and switches on or off the plurality of signal light indicator zones according to time of day or night, weather conditions and/or traffic conditions.

In another embodiment, during daylight hours all zones would be "ON", during evening hours with less traffic as detected by the TFSS, the outer zone would be turned "OFF" and during late night hours with minimal traffic as detected by the TFSS, only the center zone would be "ON", thus providing a traffic signal that adapts to the operating time, weather condition and traffic flow of the day. Additionally, independent circuit or zone control may be implemented during daylight hours when the TFSS detects no traffic in a direction. With no traffic detected, outer row circuits or zones would be turned "OFF" for that direction until the TFSS detects traffic or vehicle presence, then outer zones turned back "ON". All adaptive traffic signal lights would have zones. Multiple independent circuit LED light switching in this manner adapts to the time of day, weather conditions and traffic to increase reliability with multiple zones, and to conserve power and associated costs for intersections where implemented.

In another embodiment, the adaptive traffic signal further includes an intelligent Signal Light Monitoring System (SLMS) 1360 having a camera and a processor module mounted above the traffic signal plate 810 to continuously monitor the red LED lights 820, the yellow LED lights 824 and the green LED lights 828 and the plurality of light indicator zones provided in the top section, the center section and the bottom section respectively for signal lighting malfunction or timing malfunction. In case of detecting a lighting malfunction or a timing malfunction, the SLMS 1360 sends a malfunctioning signal indicating a condition of malfunctioning of the adaptive traffic signal to the TSCS 1738, and in-turn transmits a malfunction code to a traffic control signal monitoring center for resolution.

In another embodiment, the adaptive traffic signal further includes a support pole 902 and a cross arm pole 904. The adaptive traffic signal is mounted on the support pole 902 and/or the cross arm pole 904. The electrical power wiring, traffic signal control wiring, sensor wiring and SLMS wiring are enclosed within the support pole 902 and/or the cross arm pole 904.

In another embodiment, the plurality of red LED lights, the plurality of yellow LED lights and the plurality of green LED lights are provided in form of LED light strips 820, 824, 828 with narrow angle patterns of light distribution with a concentration of light power directly in a front direction of the adaptive traffic signal, and vary in brightness in accordance with sunlight. The LED light strips are clearly visible from a distance of at least 800 feet.

In another embodiment, each LED light strip includes a flexible plastic material affixed with LED lights. The flexible plastic material, containing the LED lights are colored or painted to match a traffic signal plate background color. The red LED light strips 820, the yellow LED light strips 824 and the green LED light strips 828 are provided in circular, square, rectangular or extended rectangular shapes.

In another embodiment, the at least one red light indicator is a red LED light module 220 affixed on the top section, the at least one yellow indicator is a yellow LED light module 224 affixed on the center section, and the at least one green light indicator is a green LED light module 228 affixed on the bottom section. The red LED light module, the yellow LED light module and the green LED light module are circular, square, rectangular or extended rectangular in shape.

In another embodiment, the adaptive traffic signal further includes an Organic light emitting diode (OLED) flat panel display 715 affixed on the traffic signal plate such that when the OLED flat panel display is in an active state, the OLED display works as a traffic control signal light. Preferably, to display a red light of the traffic control signal corresponding to a stop signal, a top part of the OLED display 720 covering the top section is activated to display red color, a center part of the OLED display 724 covering the center section and a bottom part of the OLED display 728 covering the bottom section are activated to display black or gray color. To display a yellow light of the traffic control signal corresponding to a ready to stop signal, the center part of the OLED display 724 covering the center section is activated to display yellow color, the top part of the OLED display 720 covering the top section and the bottom part of the OLED display 728 covering the bottom section are activated to display black or gray color. To display a green light of the traffic control signal corresponding to a go signal, the bottom part of the OLED display 728 covering the bottom section is activated to display green color, the top part of the OLED display 720 covering the top section and the center part of the OLED display 724 covering the center section are activated to display black or gray color. The OLED flat panel display 715 has narrow angle patterns of light distribution with a concentration of light power directly in a front direction of the adaptive traffic signal, and vary in brightness in accordance with sunlight. The OLED display 715 is clearly visible from a distance of at least 800 feet. The OLED flat panel display 715 goes into an inactive state when the adaptive traffic signal is in the inactive mode.

In another embodiment, the adaptive traffic signal further includes an LEDTV flat panel array 715 affixed to the traffic signal plate such that when the LEDTV flat panel array is in an active state, the LEDTV array works as a traffic control signal light. Preferably, to display a red light of the traffic control signal corresponding to a stop signal, a top part of the LEDTV array 720 covering the top section is activated to display red color, a center part of the LEDTV array 724 covering the center section and a bottom part of the LEDTV array 728 covering the bottom section are un-activated or activated to display black or gray color. To display a yellow light of the traffic control signal corresponding to a ready to stop signal, the center part of the LEDTV array 724 covering the center section is activated to display yellow color, the top part of the LEDTV array 720 covering the top section and the bottom part of the LEDTV array 728 covering the bottom section are un-activated or activated to display black or gray color. To display a green light of the traffic control signal corresponding to a go signal, the bottom part of the LEDTV array 728 covering the bottom section is activated to display green color, the top part of the LEDTV array 720 covering the top section and the center part of the LEDTV array 724 covering the center section are un-activated or activated to display black or gray color. The LEDTV flat panel array has narrow angle patterns of light distribution with a concentration of light power directly in a front direction of the adaptive traffic signal, and vary in brightness in accordance with sunlight. The LEDTV array is clearly visible from a distance of at least 800 feet. The LEDTV red light, yellow light and green light portions of the array are circular, square, rectangular or extended rectangular in shape. The LEDTV array goes into an inactive state when the adaptive traffic signal is in the inactive mode.

In another embodiment, the adaptive traffic signal further includes a solar panel 1154 installed on a solar panel plate 1150 above the adaptive traffic signal and/or the adaptive traffic signal's support pole and/or cross arm. The solar panel 1154 provides the electric power for all devices mounted on the adaptive traffic signal including the plurality of LED lights, or the OLED transparent flat panel display or the LEDTV array; the TFSS; the SLMS; and the TSCS.

In another embodiment, the adaptive traffic signal further includes a Battery Pack 1156 installed in close proximity to the Solar Panel 1154 where excess power will recharge the Battery Pack 1156. The Battery Pack 1156 is sufficiently sized to provide power to the adaptive traffic signal and all devices for a minimum of 36 hours in the event of solar panel malfunction or cloudy weather. The TSCS monitors the Solar panel and Battery Pack status and in the event of malfunction of the solar panel or battery pack the TSCS will forward a malfunctioning code to the central traffic control monitoring center for resolution.

Preferably, the TSCS 1738 is attached to a rear of the traffic signal plate 810 and the TSCS activates the plurality of LED lights and the plurality of light indicator zones in a predetermined sequence or phase and time to control traffic flow through an intersection. The TSCS includes two independent hardware platforms, each independent hardware platform has a CPU (Central Processing Unit) and a time clock to determine the time and sequence of the LED lights, changing from GREEN to YELLOW to RED, and then to GREEN to continue a cycle. The two independent hardware platforms include a first independent hardware platform working as a main controlling unit and a second independent platform working as a backup control unit. In case of a failure of the first independent hardware platform, the second independent hardware platform starts working as the main control unit, and a malfunction signal code is forwarded to a central traffic control monitoring center for resolution.

In another embodiment, the TSCS 1738 is configured to communicate with a central traffic network, a central traffic control monitoring center, emergency vehicles, autonomous and semi-autonomous vehicles. The communication is at least one selected from the group consisting of a Bluetooth communication, a LoRa communication, an internet communication, a cell phone network communication, an independent intranet network communication, an RF communication, a wired communication, and an optic fiber communication. Preferably, TSCS data and parameters communicated are in a coded format, where, signal codes communicated to autonomous and semi-autonomous vehicles include a signal light status, a countdown time to signal change, a distance to stop on yellow signal light to prevent red light jumping. Malfunction codes are communicated to central traffic control monitoring centers for resolution.

In another embodiment, the traffic flow sensor system (TFSS) module 135 is located on the rear of the traffic signal plate in close proximity and integrated into the TSCS to enhance the signal timing by detecting the presence of the vehicles, the speed of the vehicles, the acceleration/deceleration of the vehicles, the heading direction of the vehicles, the location of the vehicles, the turn signal status of the vehicles, the type of the vehicles, the size of the vehicles and the number of the vehicles in a traffic lane. The TFSS module is integrated with the TSCS by hard wire or via a wireless communication link.

In another embodiment, the TFSS module includes a plurality of sensors including a first EO (visual electro optical) or IR (infrared) camera for detecting vehicle data including the presence of the vehicles, the location of the vehicles, the turn signal status of the vehicles, the type of the vehicles, the size of the vehicles and the number of the vehicles in a traffic lane. The TSCS uses the vehicle data to dynamically control the traffic signal sequence and timing.

The single camera is EO (Electro Optical—standard vision) Camera and is used to detect vehicle presence, number of vehicles, and vehicle locations and may be a color or black & white camera. When detected, this data will be processed and implemented in a Signal & Timing Sequence algorithm to change signal status. For example, if the camera on an Adaptive Traffic Signal detects the presence of numerous vehicles from one direction, and the cross-street Adaptive Traffic Signal detects no vehicle presence from another direction, the TSCS will keep the GREEN Light "ON" for the direction of traffic until the TFSS for the other direction Adaptive Traffic Signal transmits a Vehicle Present Code and/or Pedestrian Present Code then the TSCS will implement a change of Light sequence. Many EO Cameras today capture imagery in low light and high resolution making day/night operations possible particularly in well-lit areas. EO Cameras detect vehicle headlights at night, but are challenged with environmental conditions like fog, heavy rain or snow, smoke and dust.

In another embodiment, the TFSS module further includes a second camera. The first camera and the second camera are focused on a same space to provide a three-dimensional sensing of the vehicles to determine a part of the vehicle data including the speed of the vehicles, the heading direction of the vehicles and an estimated time each vehicle will take to reach the intersection. The second camera is IR (Infrared) Camera. Instances where EO Cameras fall short, IR Cameras shine or more particularly, IR Cameras work well in situations with fog, heavy rain or snow, smoke and dust and the darkness of night by detecting heat. IR Cameras have also come down in price and more practical to implement.

In another embodiment, TFSS includes stereo cameras including EO & IR cameras. Two paired cameras are configured to view the same space providing for depth of field or vehicle distance from the Adaptive Traffic Signal and used to detect the number of vehicles, vehicle speed, heading direction, type, size & calculate estimated time to intersection threshold. For example, if a bus is detected or a truck is detected, traveling at a high rate of speed, the TSCS may hold the GREEN Light "ON" until the Bus and/or Truck clears the intersection before implementing the change of Light sequence. If vehicles slow sufficiently this could indicate another vehicle in the intersection turning Left or Right and the TSCS could respond by switching signal status.

In another embodiment, the TFSS module further includes radar for detecting the vehicle data including the vehicle presence, the location of the vehicles, the speed of the vehicles, an estimated time each vehicle will take to reach the intersection. Radar has the advantage of working in all weather conditions and detects vehicle presence at 500+ feet.

In another embodiment, the TFSS module further includes lidar for detecting the vehicle data including the vehicle presence, the location of the vehicles, the speed of the vehicles, an estimated time each vehicle will take to reach the intersection. Lidar works in all weather conditions and detects vehicle presence up to approximately 250 feet.

In another embodiment, the TFSS module further includes environmental sensors to detect a weather condition data including temperature, humidity, wind speed, rain, snow, ice, fog and dust. The TSCS uses the weather condition data in combination with traffic flow data to control the sequence and timing of the plurality of LED lights.

In another embodiment, the adaptive traffic signal further includes a plurality of pedestrian signs provided on sides of the support pole. The TSCS controls the plurality of pedestrian signals in synchronization with the traffic control signal.

In another embodiment, the adaptive traffic signal also includes a microphone that is either freestanding or integrated with the intelligent adaptive traffic signal light monitoring systemicamera (SLMS). The microphone can detect useful information (e.g. traffic horns, wheel sketching, vehicle collisions, etc.) and relay that information to the SLMS and TSCS and in-turn transmit select sounds to a central traffic control monitoring center for resolution.

In another embodiment, the plurality of LED lights or LED light strips may be hi-bright white in color LED lights enclosed with a color filter and/or diffuser. The color filter/diffuser may consist of glass or plastic material and filter the Red, Yellow and Green color from the hi-bright white LED lights appropriately positioned on the traffic signal plate.

In another embodiment, the color filter/diffuser may further diffuse the light so that each separate signal light appears as one consistently colored signal light and does not appear as a plurality of lights.

In another embodiment, the adaptive traffic signal may further include an OLED flat panel display or LEDTV array configured as a light bar, where the entire surface of the light signal display/array displays a red color, or a yellow color or a green color. The OLED or LEDTV light bar would further display a separate traffic light signal position, top—red, center—yellow and bottom—green on one side of the light bar as in standard traffic signals for color blind individuals to easily recognize. The other side of the OLED or LEDTV light bar may display a traffic signal sequence or phase countdown timer and wireless communication link to advise autonomous vehicles, vehicles, drivers and pedestrians of the up and coming signal change to reduce intersection red light runners.

In another embodiment, in the inactive mode the OLED flat panel display or LEDTV array reverts to displaying a flashing red light of the traffic control signal corresponding to a stop signal. A top part of the OLED display or LEDTV array covering the top section is activated to display a flashing red color, a center part and bottom part of the OLED display or LEDTV array covering the center and bottom sections are activated to display black or gray color.

In another embodiment, the adaptive traffic signal may further include a sun/privacy screen that protects the light indicators from direct sunlight. Additionally, the sun/privacy screen allows one direction of traffic to view the light indicator status, and light indicators are screened (not visible) from other directions. The sun/privacy screen may be circular, square, rectangular, or extended rectangular in shape. If the sun/privacy screen is extended rectangular in shape, it may also include egg crate type inserts due to the length of the extended LED light indicators to provide shade and to protect the light indicators from direct sunlight and to insure visibility from only one direction.

The OLED flat panel display goes into the off state when the adaptive traffic signal is in the off mode or switched off.

The LEDTV array goes into the off state when the adaptive traffic signal is in the off mode or switched off.

In another embodiment, the at least one light indicator composed of LED lights where the LED lights are powered by multiple independent electrical circuits or zones. Each zone may be independently controlled and turned on or off depending on the time of day/night and/or weather conditions, and/or traffic flow in an effort to reduce electrical power consumed and associated operating costs and to increase reliability due to the number of independent electrical circuits or zones for each signal light. For example, during rush hours or heavy traffic during daylight hours—all LED light zones are turned "ON" and during dark evening hours with moderate traffic the outer zone may be turned "OFF" with the Center zone and inner zones turned "ON". In the dark, early morning hours with little to no traffic the center zone would be turned "ON" and all outer zones turned "OFF".

In another embodiment, the adaptive traffic signal SLMS includes a neural net module mounted on the bracket above the adaptive traffic signal to continuously monitor the red LED lights, the yellow LED lights and the green LED lights respectively for lighting malfunction or LED light zone malfunction or timing malfunction. In case of detecting the lighting malfunction or zone malfunction or the timing malfunction, the neural net module sends a malfunctioning signal indicating the condition of malfunctioning of the adaptive traffic signal to the TSCS. The neural net module is configured to detect and recognize the malfunction and send a malfunction code to the TSCS and in-turn transmit the malfunction code to a central traffic monitoring center for resolution. Alternatively, the neural net module can be integrated into the SLMS.

In another embodiment, the TFSS module includes a GPS device to enhance the TSCS time clock by synchronizing to very accurate GPS timing signals to coordinate with other intersection traffic signals and automated vehicles as an accurate time standard and to provide accurate TFSS Module—GPS location.

In another embodiment, the TSCS is attached to a rear of the traffic signal plate or traffic shield and the TSCS activates the plurality of LED lights in a proper sequence and time to allow traffic flow through an intersection. The TSCS includes two independent hardware platforms, each independent hardware platform has a CPU (Central Processing Unit) and a time clock to determine the time and sequence of the LED lights, changing from GREEN to YELLOW to RED, and then to GREEN to continue a cycle. The two independent hardware platforms include a first independent hardware platform working as a main controlling unit and a second independent platform working as a backup control unit; in case of a failure of the first independent hardware platform, the second independent hardware platform starts working as the main control unit.

In one of the embodiment, the intersection traffic control system includes a plurality of adaptive traffic signals installed at an intersection. Each adaptive traffic signal includes a traffic signal plate. The traffic signal plate is divided into top section, center section and bottom section. The top section is provided with at least one red light indicator. The center section is provided with at least one yellow light indicator. The bottom section is provided with at least one green light indicator. The adaptive traffic signal includes a traffic signal control system (TSCS). The adaptive traffic signal is configured to work in an active mode or an inactive mode. In the active mode the adaptive traffic signal works as a traffic control signal and the TSCS switches on the at least one red light indicator, the at least one yellow light indicator, or the at least one green light indicator according to a traffic control signal schedule or phase. In the inactive mode the adaptive traffic signal TSCS switches off the at least one yellow light indicator, the at least one green light indicator and switches on the at least one red indicator to flashing red mode. In a condition of malfunctioning of the adaptive traffic signal, the TSCS switches the adaptive traffic signal to work in the inactive mode. The TSCS of one of the adaptive traffic signals at an intersection is selected to work as a master TSCS for the intersection traffic control system and the TSCSs of the other of the adaptive traffic signals works as slave TSCSs for the intersection traffic control system. All the TSCSs include a Master/Slave switch allowing the master TSCS to control the timing of the lights for the plurality of adaptive traffic signals. Master/Slave switch allows one Master TSCS at each intersection to control the timing of light indicators for the Master Adaptive Traffic Signal and all other intersection Slave Adaptive Traffic Signals (Slave TSCSs). All Slave Adaptive Traffic Signals light indicators are controlled by the Master TSCS. The master TSCS has a programming capability for all aspects of the intersection traffic control system including signal light timings, flashing/blinking lights, and hours of operation. Dual or Triple Redundancy Programming is implemented to program all TSCSs to increase reliability. The Master TSCS controls all intersection Adaptive Traffic Signals and aspects of the systems to include light indicator (Signal) timing, Flashing/Blinking Signals, and hours of operation. Each TSCS includes a transmitter and a receiver. The master TSCS transmits a signal code to implement a change of signal to the slave TSCSs and the slave TSCSs transmits confirmation signal codes to the master TSCS to acknowledge and verify a signal light change. For example, when the Master TSCS changes the Light (Signal) from YELLOW to RED, the Master TSCS transmits a signal code to Slave TSCSs to change their Lights (Signals) appropriately (from RED to GREEN for cross section traffic with a second or two of delay) and the Slave TSCSs will transmit confirmation signals back to the Master TSCS confirming that the LED Lights have been changed. In case the master TSCS does not receive the confirmation signal codes from the slave TSCS or receivers a slave TSCS malfunction signal, the master TSCS initiates a shut-down sequence, sending the plurality of adaptive traffic signals to work in the inactive mode and display a flashing Red light indicator for all adaptive traffic Signals and for all directions.

In another embodiment, the intersection traffic control system further includes a remote-control unit 1900 for testing and verifying operations of the intersection control system remotely, and to manually control the lights by police or emergency vehicles and/or personnel.

In another embodiment, the adaptive traffic signal includes pedestrian signal indicators and pedestrian control buttons attached to the traffic support pole. Pedestrian "WALK" and "STOP" signals give pedestrians visual signal status as to when it is safe to cross the street.

Figure 1B:
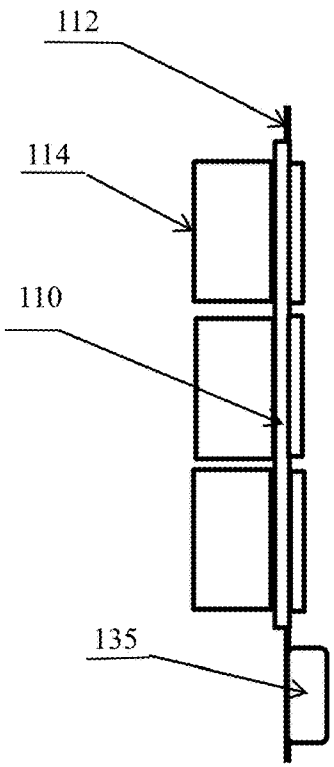
FIG. 1B shows the side view of an adaptive traffic signal, traffic signal plate, sun/privacy screens, traffic signal shield and traffic flow sensor system (TFSS) in the embodiment.
Figure 1A:
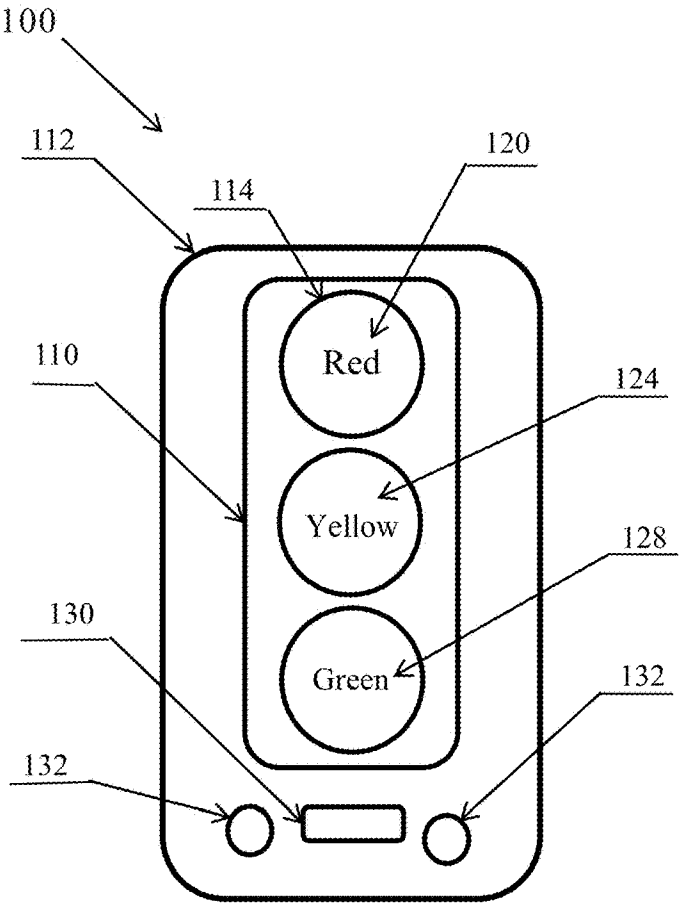
FIG. 1A shows the front view of an adaptive traffic signal consisting of circular Red, Yellow and Green signal lights surrounded by sun/privacy screens mounted on a traffic signal plate surrounded by a traffic signal shield with sensor holes or ports in the traffic signal plate according to an embodiment.

FIG. 1A-1C shows the front view, side view & rear view of an adaptive traffic signal 100 consisting of circular Red (top) 120, Yellow (center) 124 and Green (bottom) 128 signal lights and signal light privacy/sun shades 114 mounted on a traffic signal plate 110 surrounded by a traffic signal shield 112 with sensor ports 130 and/or holes 132 in the shield 112 and traffic flow sensor system (TFSS) 135 mounted on the rear lower portion of the traffic signal shield 112, with sensors installed within the TFSS 135 behind the ports and/or holes 130 & 132 and takes advantage of shade provided by the signal light privacy/sun shades 114. Sensors placed underneath the signal light privacy/sun shades 114 provide clear uninterrupted view of the road leading to the intersection. Circular signal lights can be configured with LED light modules, LED strip (tape) lights, Organic LED (OLED) flat panel displays, and/or LED TV arrays.

Figure 2C:
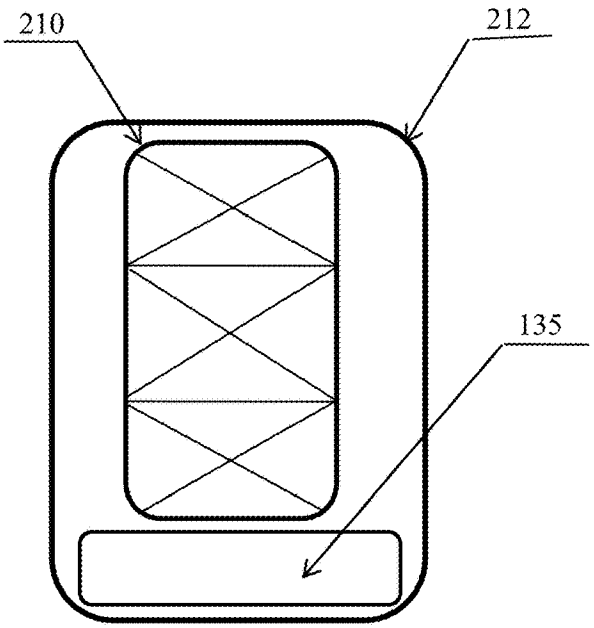
FIG. 2C shows the rear view of an adaptive traffic signal, traffic signal plate, traffic signal shield, traffic signal modules and traffic flow sensor system (TFSS) in the embodiment.
Figure 2B:
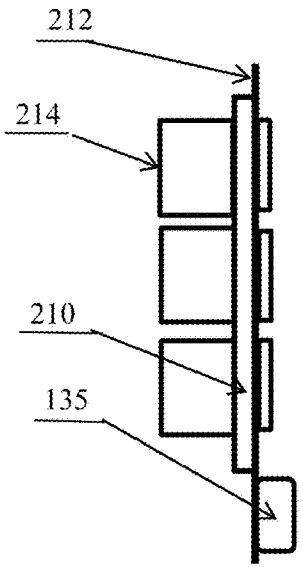
FIG. 2B shows the side view of an adaptive traffic signal, traffic signal plate, sun/privacy screen, traffic signal shield and traffic flow sensor system (TFSS) in the embodiment.
Figure 2A:
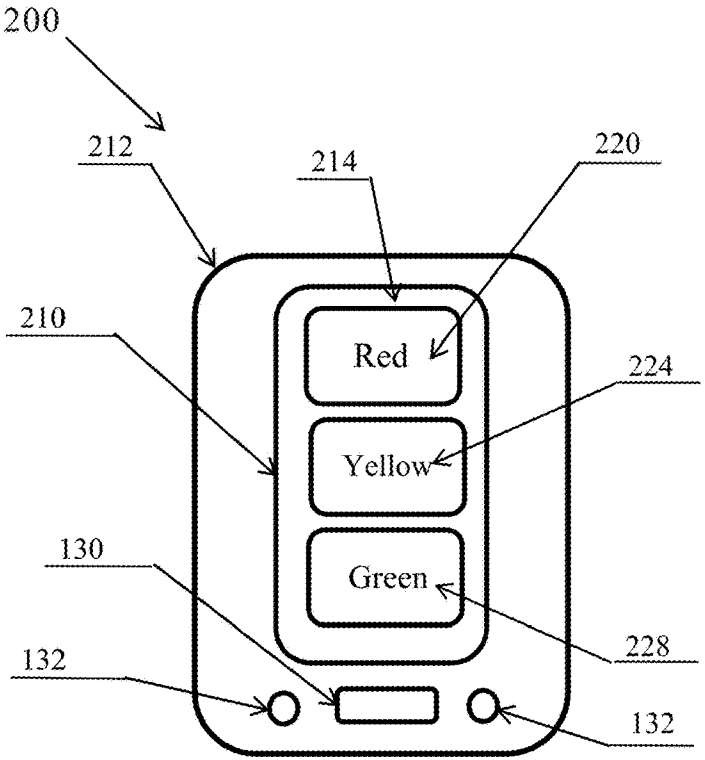
FIG. 2A shows the front view of an adaptive traffic signal consisting of rectangular Red, Yellow and Green signal lights surrounded by sun/privacy screens mounted on a traffic signal plate surrounded by a traffic signal shield with sensor holes or ports in the shield according to another embodiment.

FIG. 2A-2C show front view, side view & rear view of an adaptive traffic signal 200 consisting of square or rectangular Red (top) 220, Yellow (center) 224 and Green (bottom) 228 signal lights and signal light privacy/sun shades 214 mounted on a traffic signal plate 210 surrounded by a traffic signal shield 212 with sensor holes or ports 130 & 132 in the shield 212 and traffic flow sensor system (TFSS) 135 mounted on the rear lower portion of the traffic signal shield 212, with sensors installed within the TFSS 135 behind the holes or ports 130 & 132. The TFSS 135 location on the adaptive traffic signal 200 takes advantage of shade provided by the signal light shades 214. Sensors placed underneath the signal light privacy/sun shades 214 provide clear uninterrupted view of the road leading to the intersection. Square or rectangular signal lights can be configured with LED light modules, LED strip (tape) lights, Organic LED (OLED) flat panel displays, and/or LED TV arrays. The display area ofa square display is 21.5% greater than the display area of a circular display resulting in a larger display as viewed by drivers of vehicles.

Figure 3B:
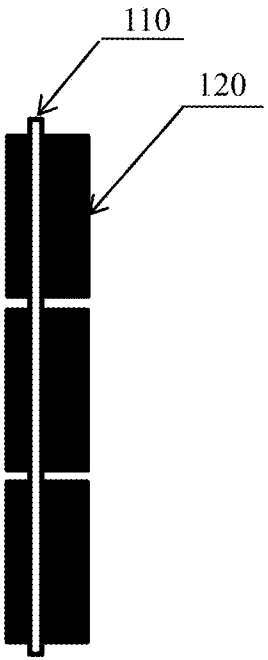
FIG. 3B shows the side view of a traffic signal plate with circular LED signal light modules in the embodiment.
Figure 3A:
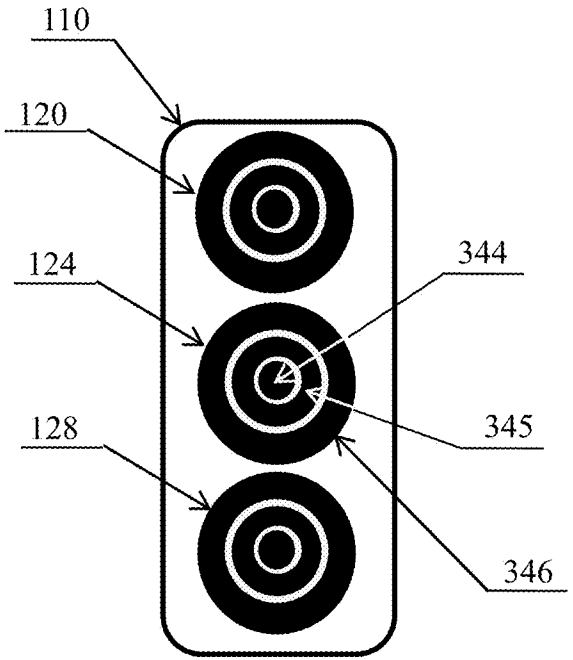
FIG. 3A shows the front view of a traffic signal plate consisting of circular Red, Yellow and Green LED signal light modules and each LED signal light module including three zones—center, inner ring and outer ring in another embodiment.

FIG. 3A-3B shows the front view and side view of a traffic signal plate 110 with circular—Red (top) 120, Yellow (center) 124 and Green (bottom) 128 LED light module array signal lights. Each LED Module Array would consist of numerous LEDs in circular rows or zones A 344, B 345 & C 346 for Yellow 124 circular modules. LED Rows would consist of two or more independent circuits for reliability and to conserve power. For example, in a six row LED light module array, one circuit could be the center two rows (rows 3&4) or zone A 344, the second circuit the next two outer rows (rows 2&5) or zone B 345, and the third circuit the outer rows (rows 1&6) or zone C 346 for Yellow 124 circular LED light modules. During daylight hours all three circuits would be "ON", during evening hours with less traffic as detected by the TFSS 135, the outer rows or zone C 346 would be "OFF" and during night hours with minimal traffic as detected by the TFSS 135, only the center rows or zone A 344 would be "ON", thus providing a traffic signal that adapts to the operating time, weather condition and traffic flow of the day. Additionally, independent circuit control may be implemented during daylight hours when the TFSS 135 detects no traffic in a direction. With no traffic detected, outer row circuits or zones B 345 & C 346 would be turned "OFF" for that direction until the TFSS 135 detects traffic, then outer rows zones B 345 & C 346 turned back "ON". All traffic signal lights would have zones similar to the Yellow 124 circular modules described, but may work independently. Multiple independent circuit LED light switching in this manner increases reliability with the number of circuits for each signal light and adapts to the time of day, weather conditions and traffic to conserve power and associated costs for intersections where implemented.

Figure 4B:
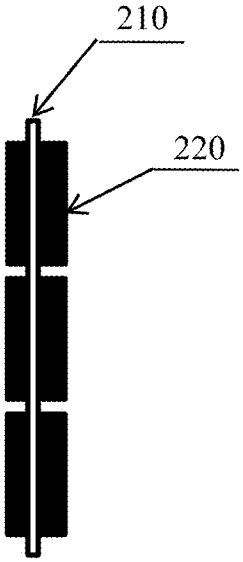
FIG. 4B shows the side view of a traffic signal plate with LED signal light modules in the embodiment.
Figure 4A:
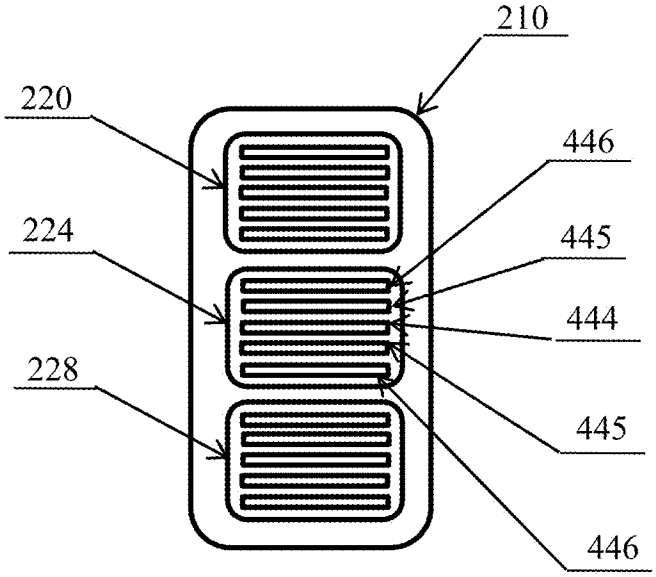
FIG. 4A shows the front view of a traffic signal plate with rectangular Red, Yellow and Green LED signal light modules including three zones—center, inner rows, outer rows in another embodiment.

FIG. 4A-4B shows the front view and side view of a traffic signal plate 210 with rectangular—Red (top) 220, Yellow (center) 224 and Green (bottom) 228 LED light module array signal lights. Each LED Module Array would consist of numerous LEDs in horizontal rows for rectangular modules. LED Rows or zones A 444, B 445 & C 446 for Yellow 224 rectangular modules and would consist of two or more independent circuits for reliability and to conserve power. For example, in a six row LED module array, one circuit could be the center two rows (rows 3&4) or Zone A 444, the second circuit the next two outer rows (rows 2&5) or Zone B 445 for, and the third circuit the outer rows (rows 1 &6) or Zone C 446 Yellow 224 rectangular modules. During daylight hours all three circuits or zones A 444, B 445 & C 446 would be "ON", during evening hours with less traffic as detected by the TFSS 135, the outer rows or zone C 446 would be "OFF" and during night hours with minimal traffic as detected by the TFSS 135, only the center rows or zone A 444 would be "ON", thus providing a traffic signal that adapts to the operating time, condition and traffic of the day. Additionally, independent circuit control may be implemented during daylight hours when the TFSS 135 detects no traffic in a direction. With no traffic detected, outer row circuits zones B 445 & C 446 would be turned "OFF" for that direction until the TFSS 135 detects traffic, then outer rows turned back "ON". All traffic signal lights would have zones similar to the Yellow 224 rectangular modules described, but may work independently. Multiple independent circuit LED light switching in this manner increases reliability with the number of circuits for each signal light and adapts to the time of day, weather conditions and traffic to conserve power and associated costs for intersections where implemented.

Figure 5B:
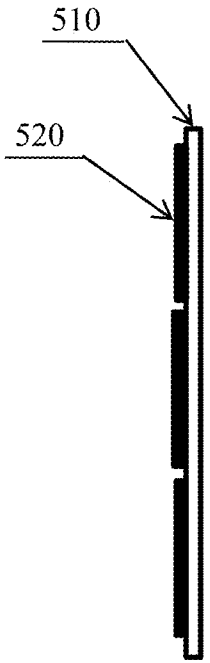
FIG. 5A shows the front view of a traffic signal plate with Red, Yellow and Green LED strip (tape) signal lights mounted on the traffic signal plate in a circular pattern including three zones—center, inner ring and outer ring in another embodiment.
FIG. 5 B shows the side view of a traffic signal plate with LED strip (tape) signal lights mounted on the traffic signal plate in the embodiment.
Figure 5A:
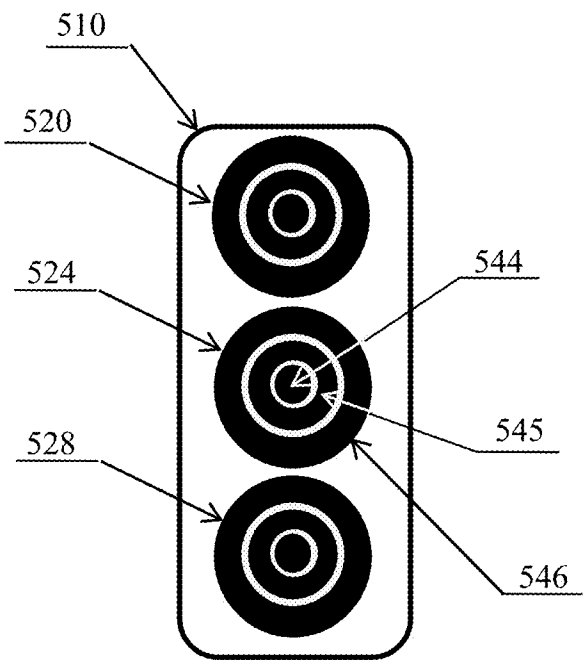

FIG. 5A-5B shows the front view and side view of a traffic signal plate 510 with circular—Red (top) 520, Yellow (center) 524 and Green (bottom) 528 LED strip (tape) signal lights affixed to the traffic signal plate 512. Each LED strip signal light would consist of numerous LED strip lights in circular rows or zones for circular signal lights. LED Rows or zones would consist of two or more independent circuits for reliability and to conserve power. For example, in a six row LED strip signal light array, one circuit could be the center two rows (rows 3&4) or Zone A 544, the second circuit the next two outer rows (rows 2&5) or Zone B 545, and the third circuit the outer rows (rows 1&6) or Zone C 546 for Yellow 524 LED strip signal lights. During daylight hours all three circuits would be "ON", during evening hours with less traffic the outer rows or Zone C 546 would be "OFF" and during night hours with minimal traffic only the center rows or Zone A 544 would be "ON", thus providing a traffic signal that adapts to the operating time, condition and traffic, as determined by the TFSS 135, of the day. Additionally, independent circuit control may be implemented during daylight hours when the TFSS 135 detects no traffic in a direction. With no traffic detected, outer row or Zone C 546 circuits would be turned "OFF" for that direction until the TFSS 135 detects traffic, then outer rows or Zone C 546 turned back "ON". All traffic LED strip signal lights would have zones similar to the Yellow 524 circular LED strip signal lights described, but may work independently. Multiple independent circuit LED strip light switching in this manner increases reliability with the number of circuits for each signal light and adapts to the time of day, weather conditions and traffic to conserve power and associated costs for intersections where implemented.

Figure 6B:
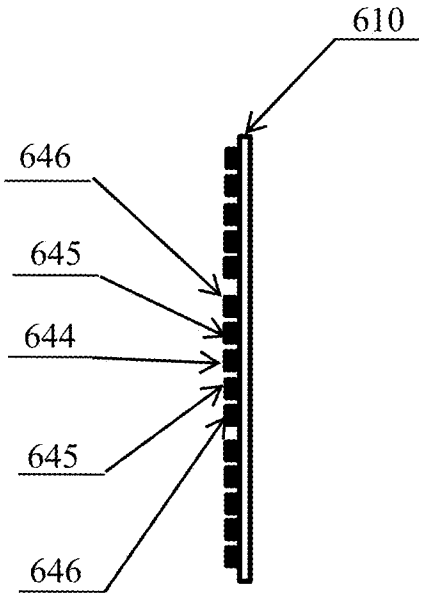
FIG. 6B shows the side view of a traffic signal plate with LED strip (tape) signal lights mounted on the traffic signal plate in the embodiment.
Figure 6A:
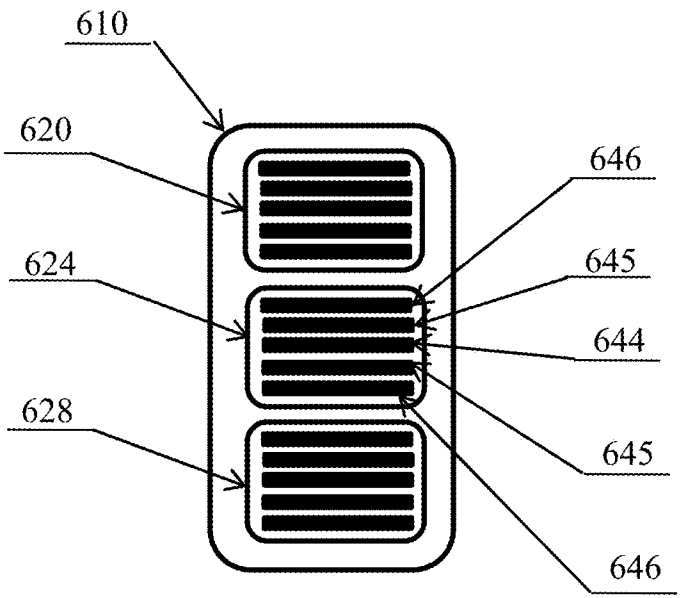
FIG. 6A shows the front view of a traffic signal plate with Red, Yellow and Green LED strip (tape) signal lights mounted on the traffic signal plate in a rectangular pattern including three zones—center, inner row and outer row in another embodiment.

FIG. 6A-6B shows the front view and side view of a traffic signal plate 610 with rectangular—Red (top) 620, Yellow (center) 624 and Green (bottom) 628 LED strip (tape) signal lights. Each LED strip signal light would consist of numerous LED strip lights in horizontal rows or zones for rectangular signal lights. LED Rows or zones would consist of two or more independent circuits for reliability and to conserve power. For example, in a six row LED strip light array, one circuit could be the center two rows (rows 3&4) or Zone A 644, the second circuit the next two outer rows (rows 2&5) or Zone B 645, and the third circuit the outer rows (rows 1&6) or Zone C 646 for Yellow 624 LED strip signal lights. During daylight hours all three circuits would be "ON", during evening hours with less traffic the outer rows or zone C 646 would be "OFF" and during night hours with minimal traffic only the center rows or zone A 644 would be "ON", thus providing a traffic signal that adapts to the operating time, condition and traffic, as determined by the TFSS 135, of the day. Additionally, independent circuit control may be implemented during daylight hours when the TFSS 135 detects no traffic in a direction. With no traffic detected, outer row circuits or zone 646 would be turned "OFF" for that direction until the TFSS 135 detects traffic, then outer rows turned back "ON". All traffic LED strip signal lights would have zones similar to the Yellow 624 rectangular LED strip signal lights described, but may work independently. Multiple independent circuit LED strip signal light switching in this manner increases reliability with the number of circuits for each signal light and adapts to the time of day, weather conditions and traffic to conserve power and associated costs for intersections where implemented.

Figure 7B:
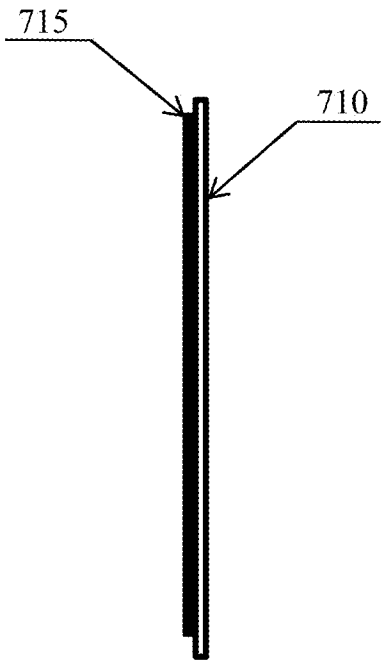
FIG. 7B shows the side view of a traffic signal plate with an OLED flat panel display mounted on the plate in the embodiment.
Figure 7A:
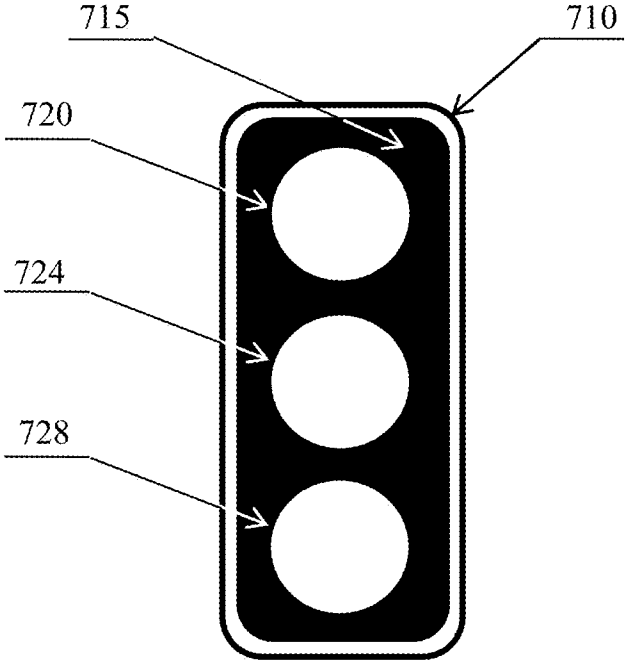
FIG. 7A shows the front view of a traffic signal plate with an OLED (Organic LED) flat panel display mounted on the plate in another embodiment.

FIG. 7A-7B shows the front view and side view of a traffic signal plate 710 with Red (top) 720, Yellow (center) 724 and Green (bottom) 728 OLED Flat Panel Display 715 signal lights. Implementing an OLED flat panel display 715 or LEDTV array will allow each signal light to be configured to a shape desired—circular, rectangular, square, extended rectangular, arrow pointing left, arrow pointing right, pedestrian symbol, etc. When implementing circular or rectangular signal lights, OLED flat panel displays 715 or LEDTV arrays will allow each signal light to be configured into multiple circuits similar to FIGS. 3-6 above. Each signal light would consist of numerous circular rows or zones for circular signal lights and horizontal rows or zones for rectangular signal lights. Signal light Rows or Zones may consist of two or more circuits for reliability and to conserve power. For example, in a six row signal light array, one circuit could be the center two rows (rows 3&4) or zone A, the second circuit the next two outer rows (rows 2&5) or zone B, and the third circuit the outer rows (rows 1 &6) or zone C. During daylight hours all three circuits would be "ON", during evening hours with less traffic the outer rows would be "OFF" and during night hours with minimal traffic only the center rows would be "ON", thus providing a traffic signal that adapts to the operating time, condition and traffic, as determined by the TFSS 135, of the day. Additionally, independent circuit control may be implemented during daylight hours when the TFSS 135 detects no traffic in a direction. With no traffic detected, outer row circuits would be turned "OFF" for that direction until the TFSS 135 detects traffic, then outer rows turned back "ON". Multiple circuit OLED flat panel display or LEDTV array signal light switching in this manner increases reliability with the number of circuits for each signal light and adapts to the time of day, weather conditions and traffic to conserve power and associated costs for intersections where implemented.

Both LED and OLED light intensity would be adaptable—during daylight hours would be highly visible to drivers in sunlight and may be dimmed in the darkness of night, and would provide clear and understandable signal conditions even to color blind individuals. Additionally, LED and OLED signal Light outer zones would be turned off at night, with minimal traffic and good weather conditions as determined by the TFSS. In case of inner zone malfunction, the signal lights would revert to the outer zone circuits and continue operation, notify the TSCS and in-turn notify the central traffic control monitoring center for resolution, thereby increasing traffic signal light reliability and reducing power requirements and associated costs.

Square, rectangular or extended rectangular shape LED traffic signal lights may be less costly to manufacture and cover more area and contain more LEDs than equivalent sized circular lights by approximately 21.5% for a square module of the same size and therefore appear larger and brighter to drivers particularly on bright sunny days with the intent of reducing intersection red light runners and accidents.

OLED display or LEDTV array traffic signal lights can further enhance traffic controlled intersections by providing substantially larger circular, square, rectangular or extended rectangular signal lights resulting in increased signal light driver visual cues. These signal lights could also provide an individual signal light or phase count down on the OLED display or LEDTV array, providing drivers with the exact time of signal light change with the goal of reducing red light runner accidents, the most prevalent accidents at intersections.

Figure 8B:
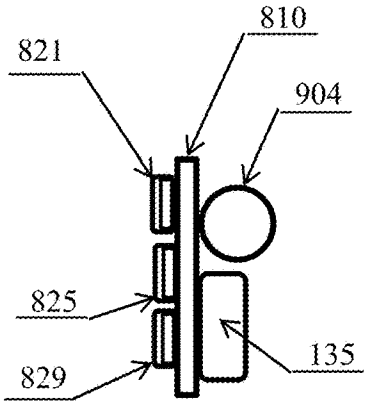
FIG. 8B shows the side view of an adaptive traffic signal mounted on a cross arm support pole, traffic signal plate with mounted LED strip signal lights with color filters/diffusers and traffic flow sensor system (TFSS) in the embodiment.
Figure 8A:
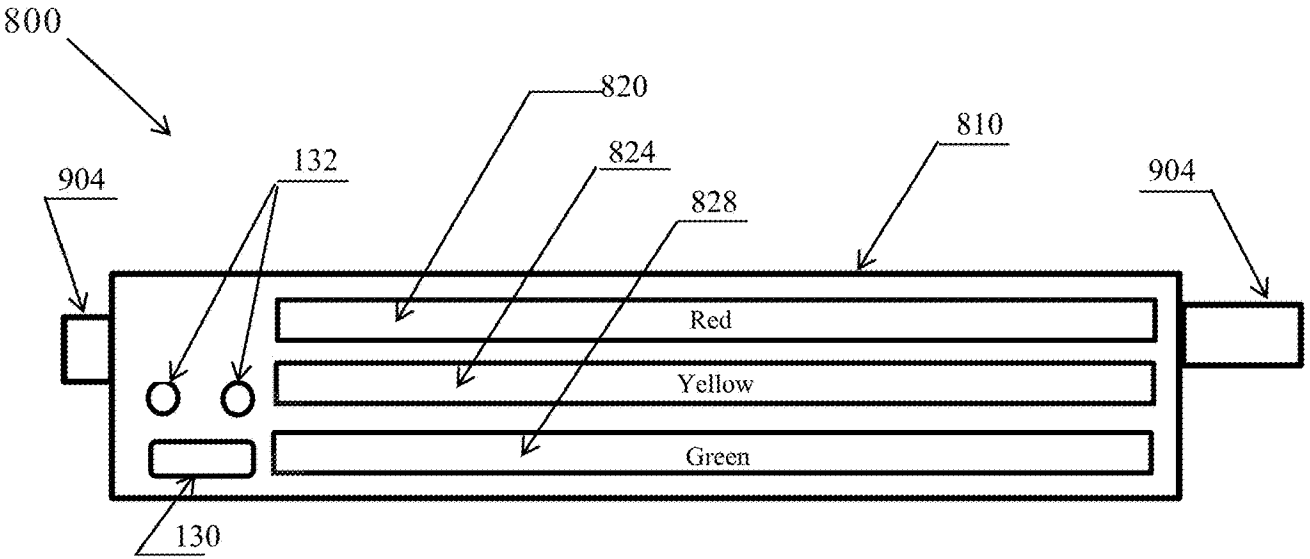
FIG. 8A shows the front view of an adaptive traffic signal mounted on a cross arm support pole consisting of extended rectangular Red, Yellow and Green LED strip (tape) signal lights mounted on a traffic signal plate with sensor holes or ports in the plate according to another embodiment.
Figure 9:
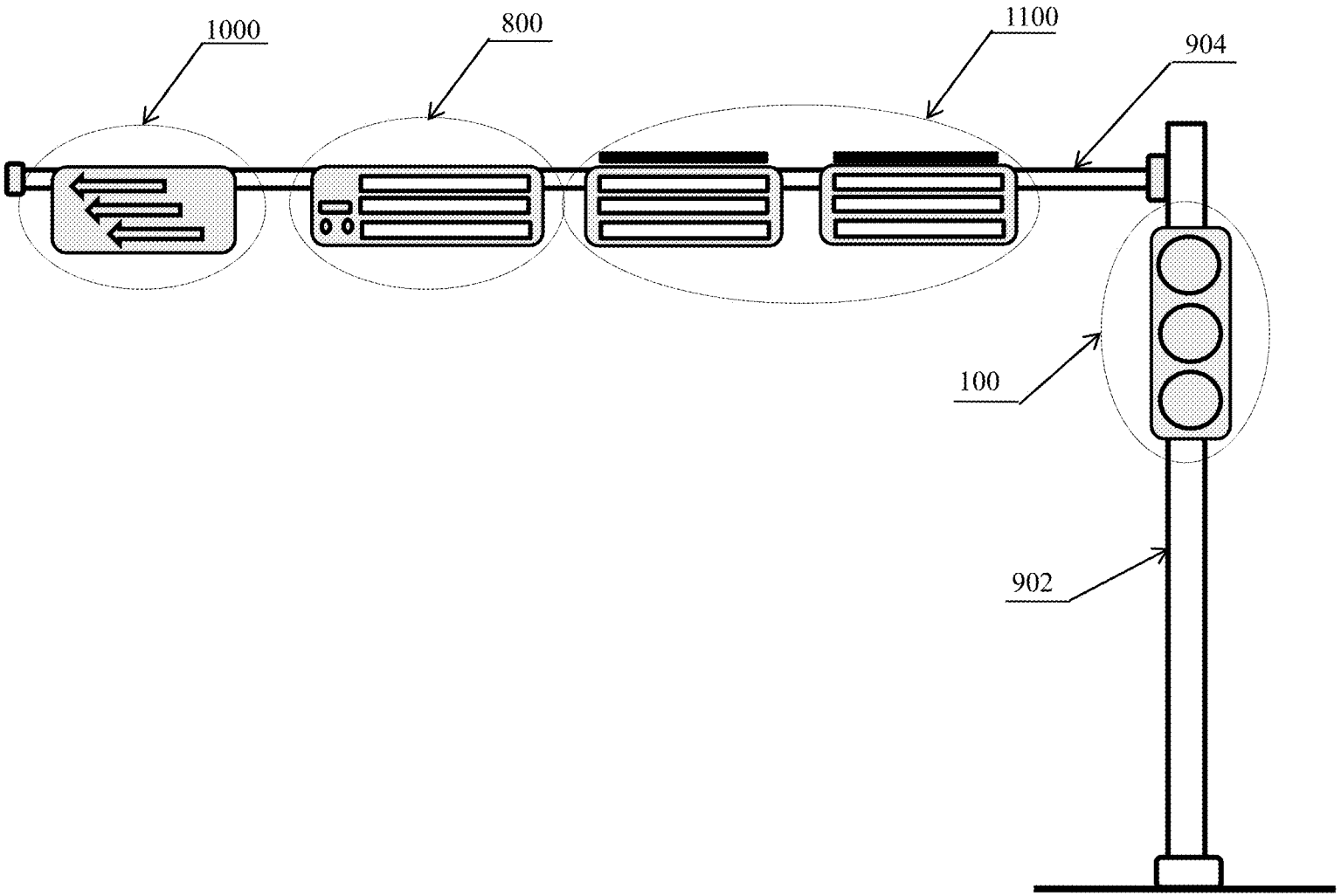
FIG. 9 shows the front view of a traffic signal support pole and cross arm with an extended rectangular adaptive traffic signal, extended rectangular traffic signals, and extended rectangular turn traffic signal mounted horizontally on the cross arm support pole and a circular traffic signal mounted vertically on the support pole in another embodiment.

FIG. 8A shows the front view of an extended rectangular adaptive traffic signal 800 mounted on a cross arm pole (FIG. 9—904). The extended rectangular adaptive traffic signal 800 consists of a traffic signal plate 810 with sensor holes or ports 130 & 132 and Red 820, Yellow 824 and Green 828 LED modular array or LED strip (tape) signal lights mounted on the plate 810. Extended rectangular traffic signal lights provide the same or greater light intensity due to the greater signal light area as compared with circular, square or rectangular signal lights.

FIG. 8B shows the side view of an extended rectangular adaptive traffic signal 800 mounted on a cross arm pole (FIG. 9—904). The extended rectangular adaptive traffic signal 800 consists of a traffic signal plate 810 with a traffic flow sensor system (TFSS) 135 and Red 821 color filters/diffusers, Yellow 825 color filters/diffusers and Green 829 color filters/diffusers—LED modular array or strip (tape) light—signal lights with color filters/diffusers mounted on the plate 810.

Figure 8C:
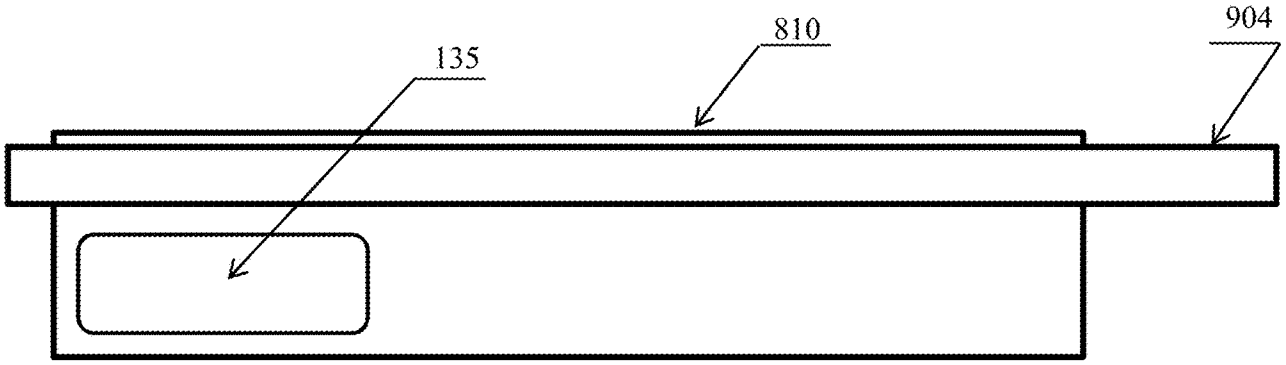
FIG. 8C shows the rear view of an adaptive traffic signal mounted on a cross arm support pole, traffic signal plate with mounted traffic flow sensor system (TFSS) in the embodiment.

FIG. 8C shows the rear view of an extended rectangular adaptive traffic signal 800 mounted on a cross arm pole (FIG. 9—904). The adaptive traffic signal consists of a traffic signal plate 810 with a TFSS 135 mounted on the plate.

FIG. 9 shows the front view of a support pole 902 and cross arm pole 904 with a circular traffic signal (FIG. 1—100) mounted vertically on a traffic signal support pole 902 and extended rectangular adaptive traffic signal 800, extended rectangular traffic signals (FIG. 11—1100) and extended rectangular directional traffic signal lights (FIG. 10—1000) mounted horizontally or at a slight angle on a cross arm pole 904.

Figure 10:
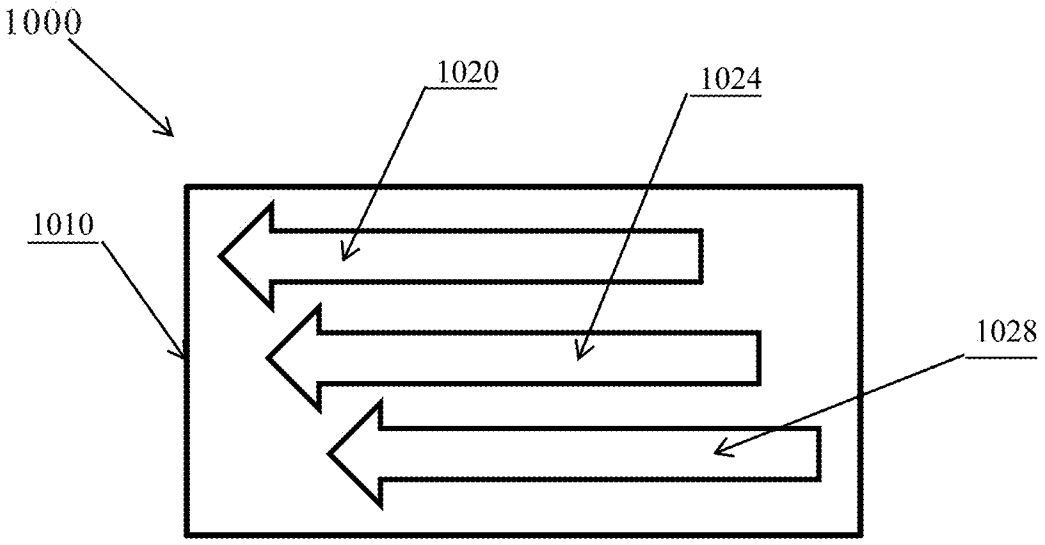
FIG. 10 shows the front view of a traffic signal light—left turn arrows mounted according to another embodiment.

FIG. 10 shows the front view of an extended rectangular directional traffic signal plate 1010 with a Red 1020, Yellow 1024, and Green 1028 LED modules, LED strip lights, OLED display or LEDTV array—directional signal lights.

Figure 11A:
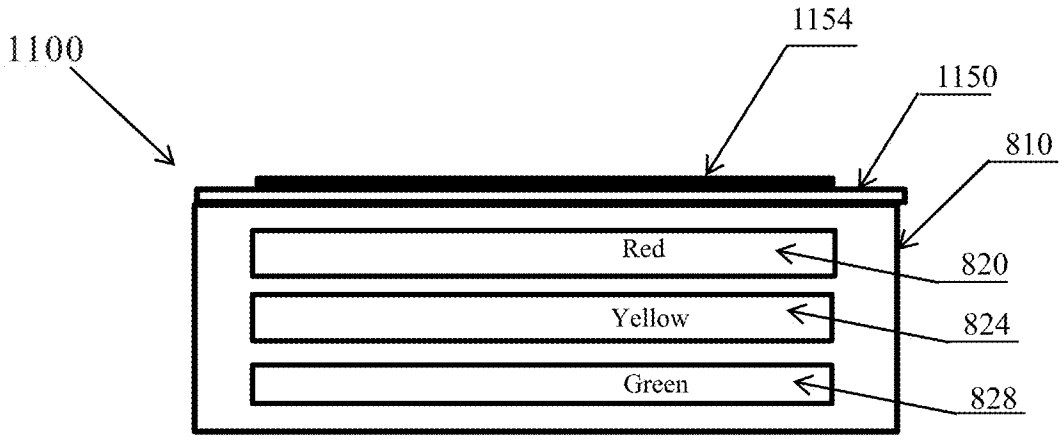
FIG. 11A shows the front view of an adaptive traffic signal and traffic signal plate with LED strip signal lights, solar support plate and solar panel array mounted above the traffic signal plate according to another embodiment.
Figure 11B:
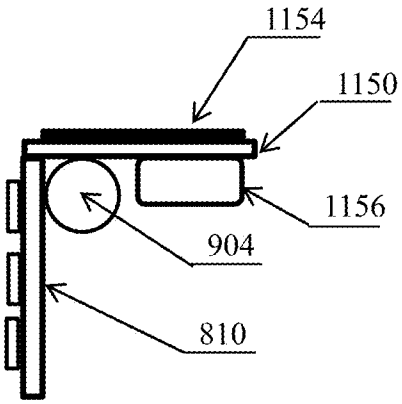
FIG. 11B shows the side view of a traffic signal plate with solar support plate and solar panel array mounted above the traffic signal plate and a battery pack mounted below the solar support plate on the rear according to the embodiment.

FIGS. 11A & 11B shows the front view and side view of an extended rectangular traffic signal plate 810, and solar panel support plate 1150 mounted on the top edge of the traffic signal plate 810 and on the cross arm support pole 904. Solar panels 1154 mounted on the top surface of the solar panel support plate 1150 and rechargeable battery pack 1156 mounted underneath the solar panel support plate 1150 and toward the rear of the traffic signal plate 810. Solar Panel 1154 is sized appropriately for power output sufficient to power the adaptive traffic signal and all components on the traffic signal plate and solar support plate to include LEDs, OLEDs, LEDTVs, TFSS, TSCS, Sensors and charge batteries simultaneously. Rechargeable Battery Pack 1156 sized sufficiently to provide continuous power to all components on the adaptive traffic signal for a minimum of 36 continuous hours.

Figure 11C:
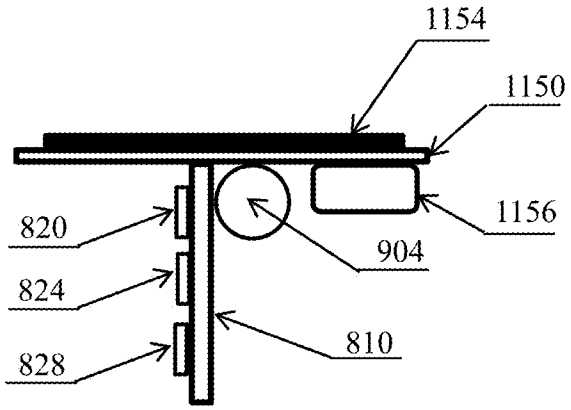
FIG. 11C shows the side view of a traffic signal plate with another solar support plate—solar panel array configuration mounted above the traffic signal plate and a battery pack mounted below the solar support plate on the rear according to the embodiment.

FIG. 11C shows a side view of another embodiment with the solar panel plate 1150 and solar panel 1154 mounted to the top and extending to the front and rear of the adaptive traffic signal plate 810 and mounted on a cross arm pole 904, so that the solar panel 1154 size is substantially increased and the front portion of the solar panel plate 1150 overhangs the front of the extended traffic signal plate 810 and provides shade. Rechargeable battery pack 1156 mounted underneath the solar panel support plate 1150 and on the rear side of the traffic signal plate 810.

Figure 11D:
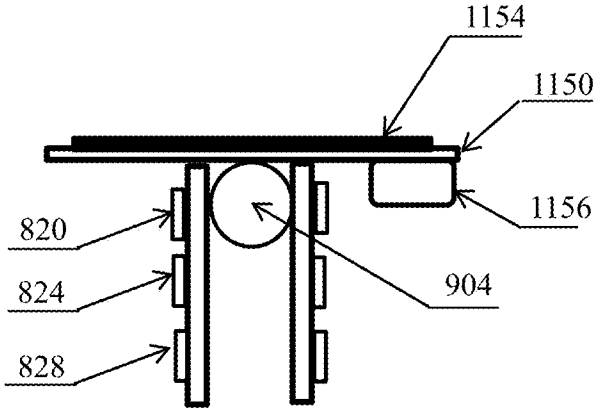
FIG. 11D shows the side view of a traffic signal plate with another solar support plate—solar panel array configuration mounted above the traffic signal plate and a battery pack mounted below the solar support plate on the rear according to the embodiment.
Figure 12A:
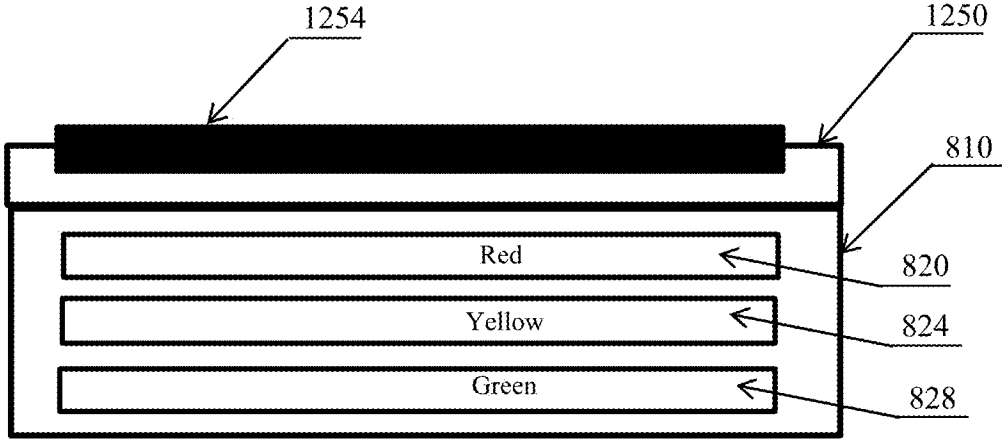
FIG. 12A shows the front view of a traffic signal and traffic signal plate with LED strip signal lights, curved solar support plate and curved solar panel array mounted above the traffic signal plate according to another embodiment.
Figure 12B:
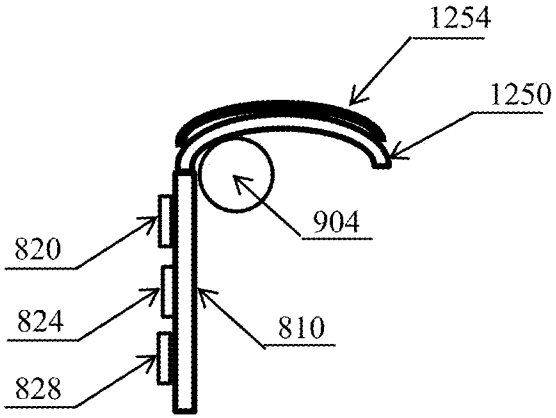
FIG. 12B shows the side view of a traffic signal plate with LED strip signal lights, curved solar support plate and curved solar panel array mounted above the traffic signal plate according to the embodiment.
Figure 12C:
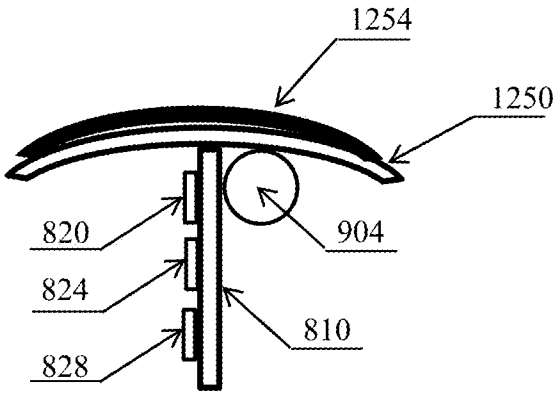
FIG. 12C shows the side view of a traffic signal plate with another curved solar support plate—solar panel array configuration mounted above the traffic signal plate according to the embodiment.
Figure 12D:
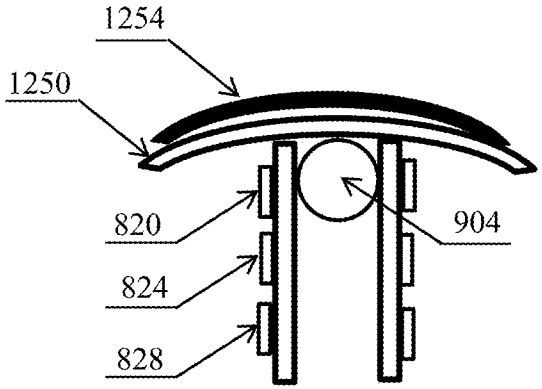
FIG. 12D shows the side view of a traffic signal plate with another curved solar support plate—solar panel array configuration mounted above the traffic signal plate according to the embodiment.

FIG. 11D shows a side view of another embodiment with the solar panel plate 1150 and solar panel 1154 mounted to the top and extending to the front and rear of the extended adaptive traffic signal plate 810 and mounted on a cross arm pole 904 with a second extended adaptive traffic signal plate 810 facing the opposite direction mounted to the cross arm pole 904 and underneath the solar panel plate 1150 and solar panel 1154 so that the solar panel 1154 size is substantially increased and both front and rear portions overhang the front of both adaptive traffic signal plates 810 and provides shade. Rechargeable battery pack 1156 mounted underneath the solar panel support plate 1150 and on the rear side of the traffic signal plate 810.

FIG. 12A-FIG. 12D shows other embodiments with curved solar panel support plates 1250 and flexible solar panel arrays 1254 in place of flat solar panel support plates 1150 and solar panels 1154 as in FIG. 11A-FIG. 11D. Curved flexible solar panels 1254 may provide higher average solar power capture rates over longer time durations during daylight hours.

Figure 13B:
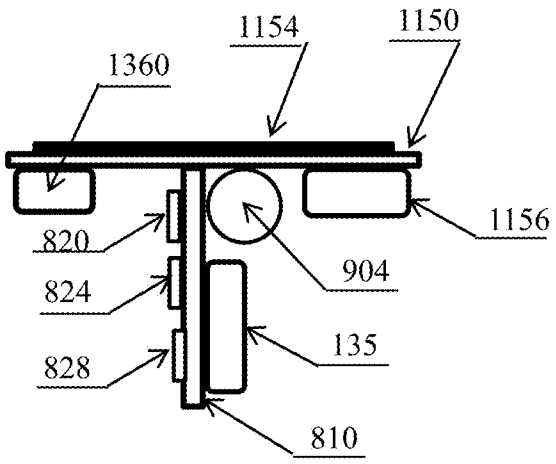
FIG. 13B shows the side view of a traffic signal plate with LED light strips and solar support plate—solar panel array with a signal light monitoring system (SLMS) mounted on the front edge of the solar support plate and a battery pack mounted on the rear edge of the solar support plate to the embodiment.
Figure 13A:
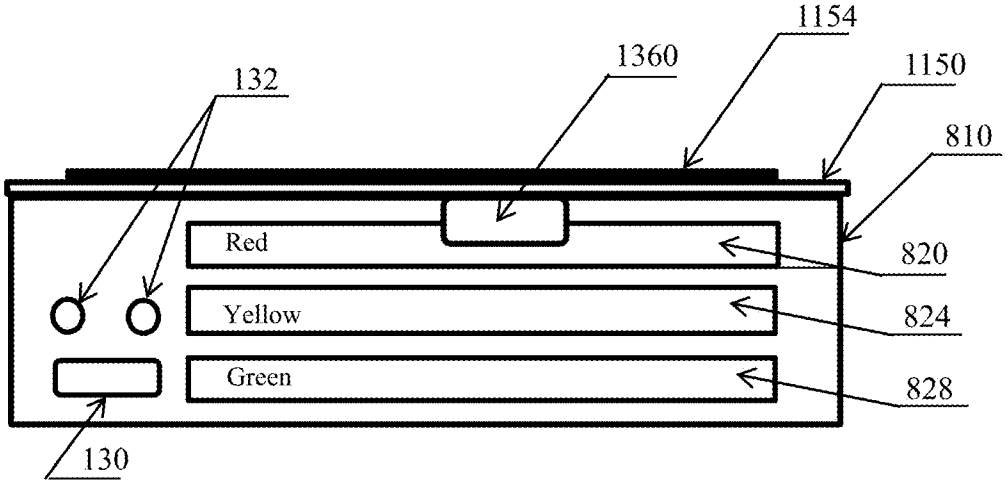
FIG. 13A shows the front view of an adaptive traffic signal and traffic signal plate with LED light strips with a signal light monitoring system (SLMS) mounted on the front side edge of the solar support plate and mounted above the adaptive traffic signal according to another embodiment.

FIGS. 13A & 13B shows the front view and side view of an extended rectangular adaptive traffic signal plate 810 with sensor ports 130 and holes 132, and solar panel support plate 1150 mounted on the top edge of the extended rectangular adaptive traffic signal plate 810. Solar panel support plate 1150 extends to the rear and front and overhangs the front of the extended rectangular adaptive traffic signal plate 810. Solar panels 1154 mounted on the top surface of the solar panel support plate 1154 and rechargeable battery pack 1156 mounted underneath the solar panel support plate 1150 and toward the rear side of the extended rectangular adaptive traffic signal plate 810. Solar Panel 1154 is sized appropriately for power output sufficient to power all components on the extended rectangular adaptive traffic signal, to include: LEDs/OLEDs/LEDTV, TSCS, Sensors and charge batteries simultaneously.

Rechargeable battery Pack 1156 sized sufficiently to provide continuous power to all components on the extended rectangular adaptive traffic signal for a minimum of 36 continuous hours. The solar panel support plate 1150 is mounted in such a manner to have one edge overhanging the front of the extended rectangular adaptive traffic signal plate 810, so that a signal light monitoring system (SLMS) 1360 mounted near this edge will have clear visibility to all LED/OLED signal lights with visual access through any sun/privacy shades installed (not shown here). The SLMS consists of a camera & processor and will provide continuous monitoring of the OLED/LEDTV/LED/strip signal lights so that in the event of a malfunction of any of the signal lights or timing malfunction of the signal lights, the traffic signal control system will automatically notify the central traffic monitoring center and/or maintenance personnel of this malfunction for resolution. Depending on the malfunction, the TSCS may shut down all intersection adaptive traffic signals and revert to flashing red signal lights for all directions advising all vehicles to stop prior to proceeding through intersections.

Figure 14B:
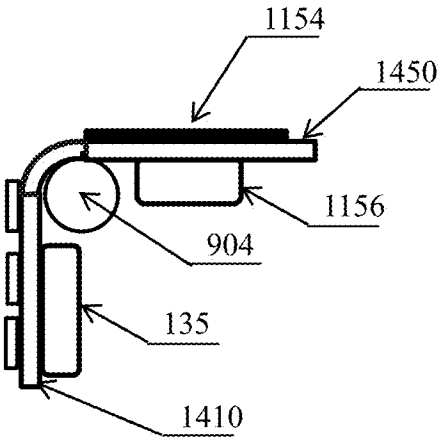
FIG. 14B shows the side view of a traffic signal plate and solar support plate bent at 90 degree angle with LED strip signal lights on the traffic signal plate portion and solar panel array on the support plate and a battery pack mounted below the solar support plate on the rear according to the embodiment.
Figure 14A:
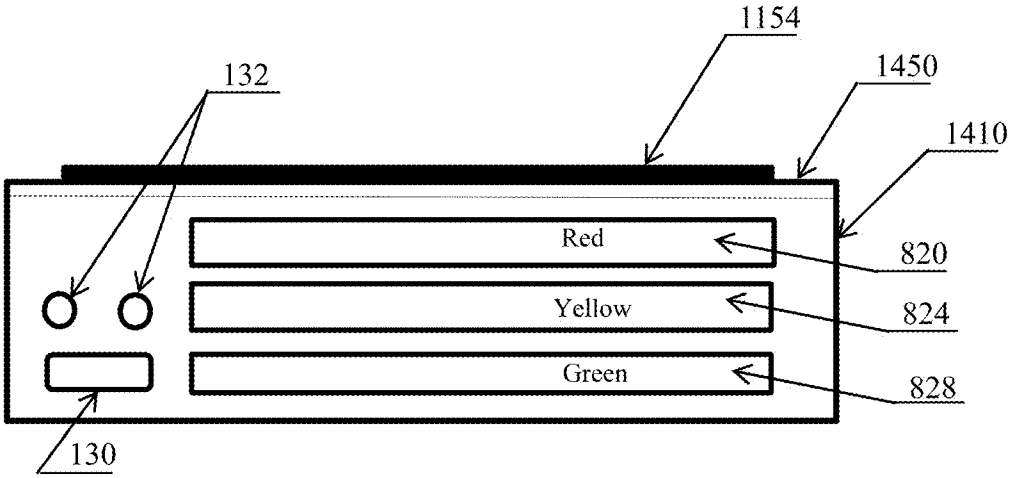
FIG. 14A shows the front view of an adaptive traffic signal with the traffic signal plate and solar support plate bent at 90 degree angle with LED strip signal lights on the traffic signal plate portion and solar panel array on the support plate portion according to another embodiment.

FIG. 14A shows the front view of an extended rectangular adaptive traffic signal with the traffic signal plate portion 1410 and solar support plate portion 1450 are bent at a 90 degree angle. The traffic signal portion 1410 has sensor holes 132 and port 130 with mounted red 820, yellow 824 and green 828 LED strip, OLED display or LEDTV array signal lights, and solar panel 1154 mounted on the support plate portion 1450 according to another embodiment;

FIG. 14B shows the side view of an extended rectangular adaptive traffic signal with the traffic signal plate portion 1410 and solar support plate portion 1450 are bent at 90 degree angle and mounted on a cross arm pole 904. The adaptive traffic signal portion 1410 has LED strip, OLED display and/or LEDTV array signal lights, and TFSS mounted on the traffic signal plate, and the solar support plate portion 1450 has a solar panel 1154 mounted above and battery pack 1156 mounted below according to another embodiment.

Figure 15:
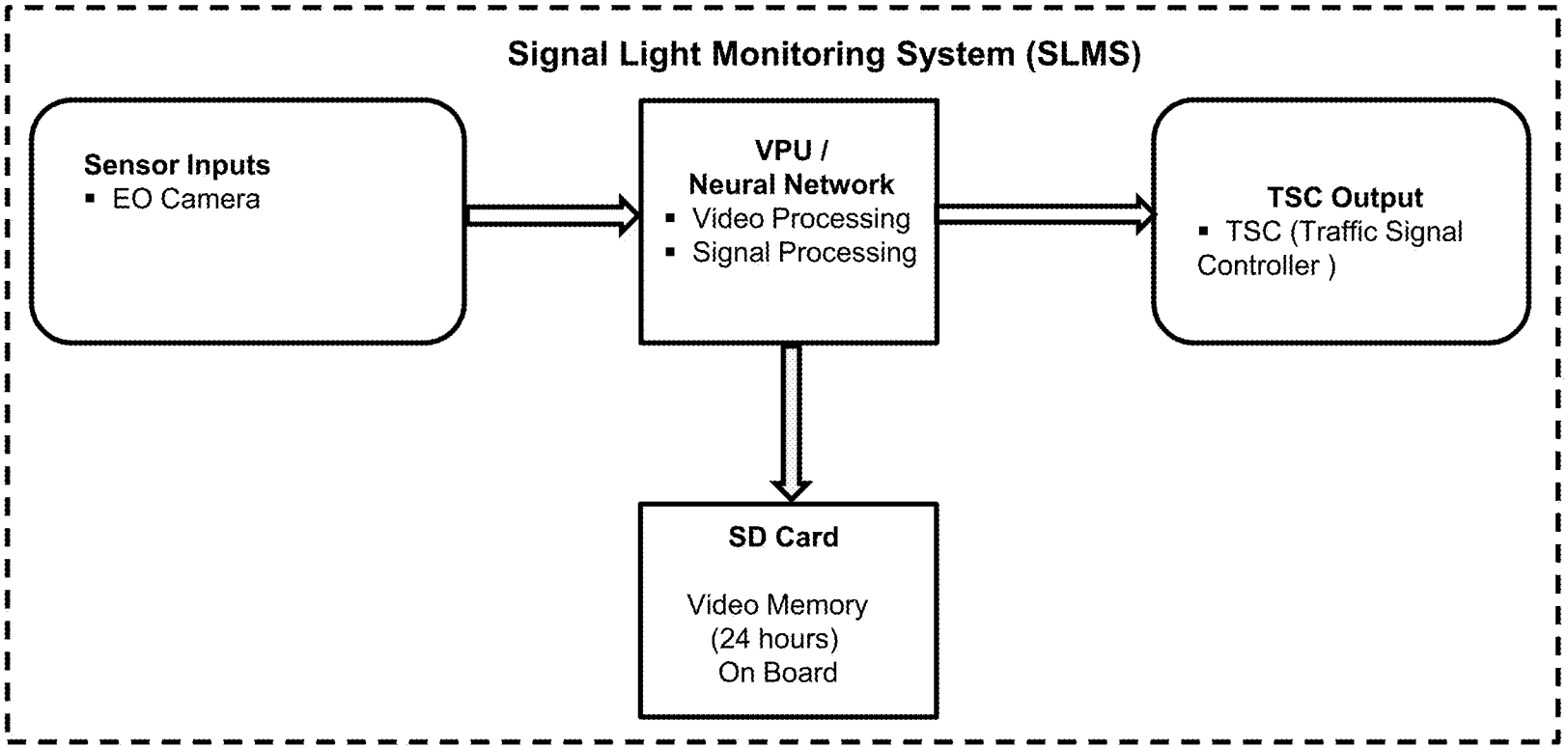
FIG. 15 shows a block diagram of the Signal Light Monitoring System (SLMS) according to another embodiment.

FIG. 15 shows a Block Diagram of the Signal Light Monitoring System (SLMS) composed of an EO (visible light) camera, Video Processing Unit (VPU), Neural Network (NN) and SD Card supporting up to 8+ hours of video capture. The SLMS provides continuous monitoring of the LEDTV/OLED/LED strip signal lights so that in the event of a malfunction of any of the signal lights or timing malfunction of the signal lights, the SLMS will communicated to the traffic signal control system (TSCS) and the TSCS will automatically notify the central traffic monitoring center and/or maintenance personnel of this malfunction for resolution. Depending on the malfunction, the TSCS may shut down the system for all intersection Adaptive Traffic Signals and revert to flashing red signal lights for all directions advising all vehicles to stop prior to proceeding through the intersection.

The Vision Processing Unit (VPU)/Neural Network Chip manufactured by INTEL, NVIDIA, QUALCOM, GENERAL VISION and others may be used for processing. INTEL has a VPU chip that features a Neural Compute Engine with 16 core processors each providing the ability to perform separate pipeline algorithms, sensor fusion and/or convolution neural networks all in a low power chip suitable for battery operation. The Neural Compute Engine portion adds hardware accelerators designed to dramatically increase performance of deep neural networks without including the low power characteristics of the chip. Known software and algorithms will be applied to this chip or others to detect, recognize and analyze vehicle presence, number of vehicles, vehicle type, location, speed and expected time to intersection threshold. INTEL and GENERAL VISION both have low power chips that perform RBF (Radial Basis Function) neural networks in real time and can be considered Fast Learning (as opposed to Deep Learning) processors. GENERAL VISIONS's chips have 576 neurons with low power characteristics in a very small package, where each neuron consists of a processor and memory. Neurons can be configured in parallel or hierarchical and suitable for fast or real time learning and provides real time image or signal detection, classification and recognition. These processors (chips) are taught and not necessarily programmed, so programming is simplified and known by technologists in that field.

Figure 16:
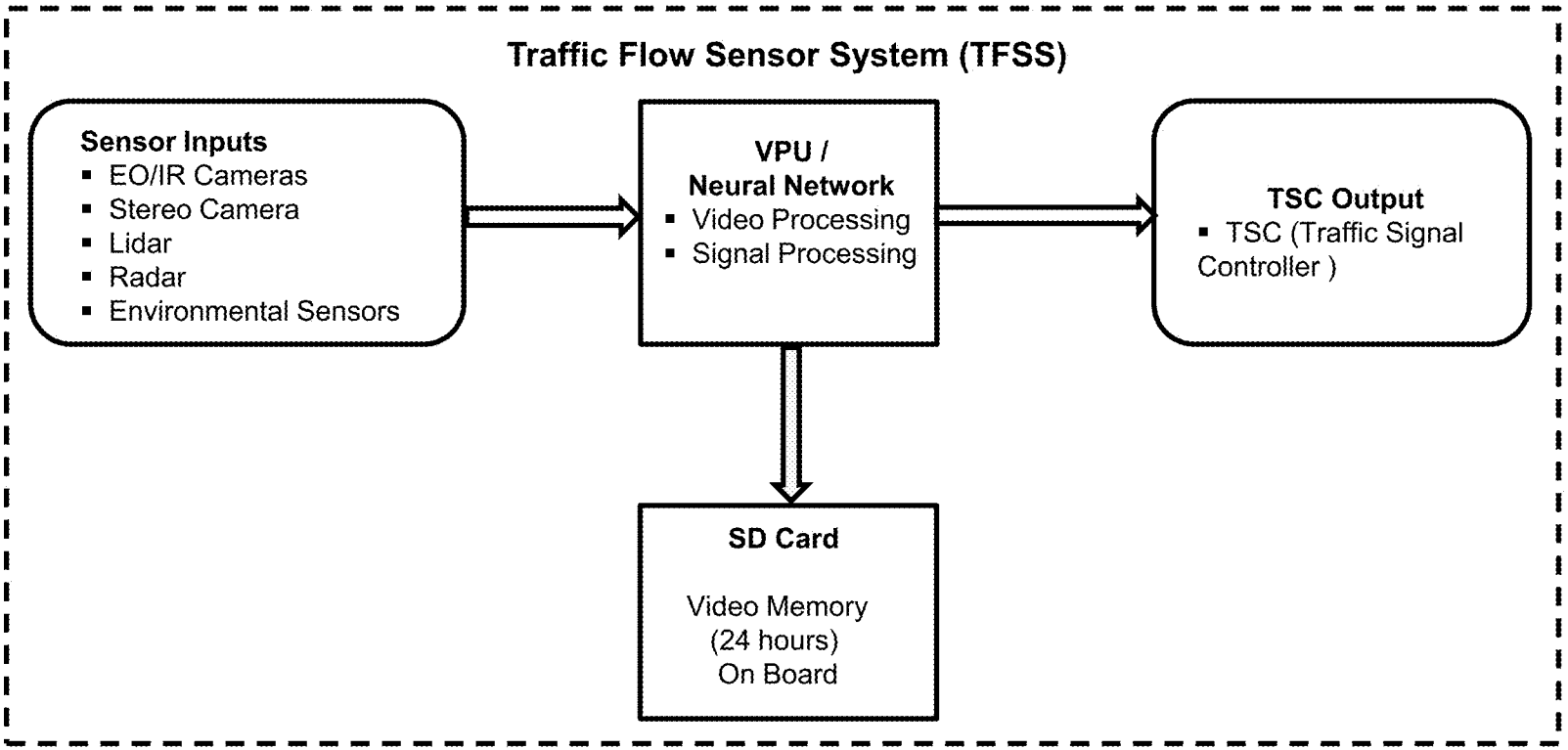
FIG. 16 shows a block diagram of the traffic Flow Sensor System (TFSS) according to another embodiment.

FIG. 16 shows a Block Diagram of the Traffic Flow Sensor System (TFSS) module composed of an EO (visible light) camera, and/or an IR (infrared) camera, and/or an EO and/or IR stereo camera, and/or a radar, and or a lidar, and/or environmental or weather sensor, Video Processing Unit (VPU), Neural Network (NN) and SD Card supporting up to 8+ hours of video capture mounted to the rear of adaptive traffic signal plates, sealed to the environment, and provides for video & signal processing and algorithms required for traffic flow detection, identification and analysis. The TFSS will interface directly (hard wired) with standard PLC Traffic Signal Controllers and/or local TCSCs (mounted on Adaptive traffic Signals) and via communications links for Remote TFSSs (mounted elsewhere).

The Vision Processing Unit (VPU)/Neural Network Chip manufactured by INTEL, NVIDIA, QUALCOM, GENERAL VISION and others may be used for processing. INTEL has a VPU chip that features a Neural Compute Engine with 16 core processors each providing the ability to perform separate pipeline algorithms, sensor fusion and/or convolution neural networks all in a low power chip suitable for battery operation. The Neural Compute Engine portion adds hardware accelerators designed to dramatically increase performance of deep neural networks without including the low power characteristics of the chip. Known software and algorithms will be applied to this chip or others to detect, recognize and analyze vehicle presence, number of vehicles, vehicle type, location, speed and expected time to intersection threshold. INTEL and GENERAL VISION both have low power chips that perform RBF (Radial Basis Function) neural networks in real time and can be considered Fast Learning (as opposed to Deep Learning) processors. GENERAL VISIONS's chips have 576 neurons with low power characteristics in a very small package, where each neuron consists of a processor and memory. Neurons can be configured in parallel or hierarchical and suitable for fast or real time learning and provides real time image or signal detection, classification and recognition. These processors (chips) are taught and not necessarily programmed, so programming is simplified and known by technologists in that field.

The TFSS module may include a plurality of sensors including a first camera for detecting a vehicle data including the vehicle presence, the number of the vehicles, the location of the vehicles, the type of the vehicles, the size of the vehicles and the turn signal status of the vehicles. The vehicle data is used to control the traffic signal sequence and timing. The TSCS uses the vehicle data to dynamically control the traffic signal sequence and timing.

The TFSS module may further include a second camera. The first camera and the second camera are focused on a same space to provide a three dimensional sensing of the vehicles to determine a part of the vehicle data including the speed of the vehicles, the heading direction of the vehicles, vehicle acceleration or deceleration and an estimated time each vehicle will take to reach the intersection. The first camera and the second camera should be aligned and calibrated at the manufacturing facility or factory with the ability to easily adjust the cameras at the intersection location. The camera pair should be adjusted to view the desired intersection scene or highway lanes at the time of installation. Cameras should have the same lens and field of view specifications for all EO and IR camera combinations.

The TFSS module may further include a radar sensor for detecting the vehicle data including the vehicle presence, the location of the vehicles, the speed of the vehicles, vehicle acceleration or deceleration, an estimated time each vehicle will take to reach the intersection.

The TFSS module may further include a lidar sensor for detecting the vehicle data including the vehicle presence, the location of the vehicles, the speed of the vehicles, vehicle acceleration or deceleration, an estimated time each vehicle will take to reach the intersection.

The TFSS module may further include environmental sensors to detect weather condition data including rain, snow, fog, and blowing sand. The TSCS uses the weather condition data to control the sequence and timing of the plurality of LED lights and to work in conjunction with a vision processing unit to detect, recognize, and analyze the vehicle data including the vehicle presence, the number of vehicles, the type of the vehicles, the location of the vehicles, the speed of the vehicles, vehicle acceleration or deceleration, and the expected time to reach the intersection for each vehicle.

Figure 17B:
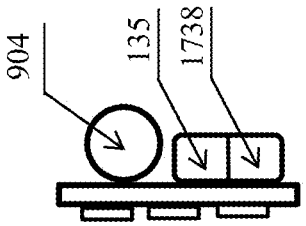
FIG. 17B shows the side view of an adaptive traffic signal mounted on a cross arm support pole, traffic signal plate with mounted LED strip signal lights, traffic flow sensor system (TFSS) and traffic signal control system (TSCS) in the embodiment.
Figure 17A:
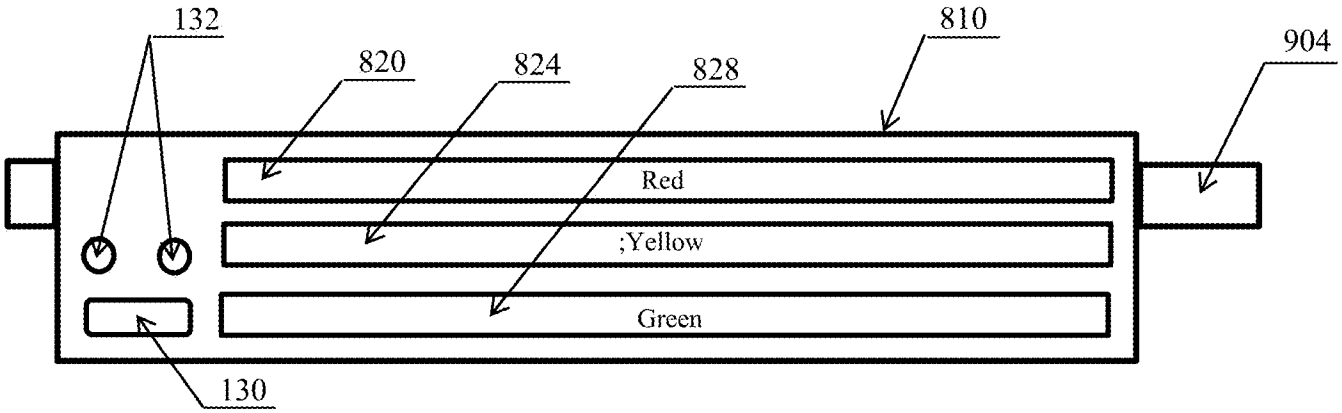
FIG. 17A shows the front view of an adaptive traffic signal mounted on a cross arm support pole consisting of extended rectangular Red, Yellow and Green LED strip (tape) signal lights mounted on a traffic signal plate with sensor holes or ports in the plate according to another embodiment.

FIG. 17A shows the front view of an extended rectangular adaptive traffic signal plate 810 mounted on a cross arm pole 904 with sensor holes 132 & port 130 and Red 820, Yellow 824 and Green 828 LED strip signal lights attached.

FIG. 17B shows the side view of an extended rectangular adaptive traffic signal plate 810 mounted on a cross arm pole 904 with LED strip signal lights, a TFSS 135 and a traffic signal control system (TSCS) 1738 attached.

Figure 17C:
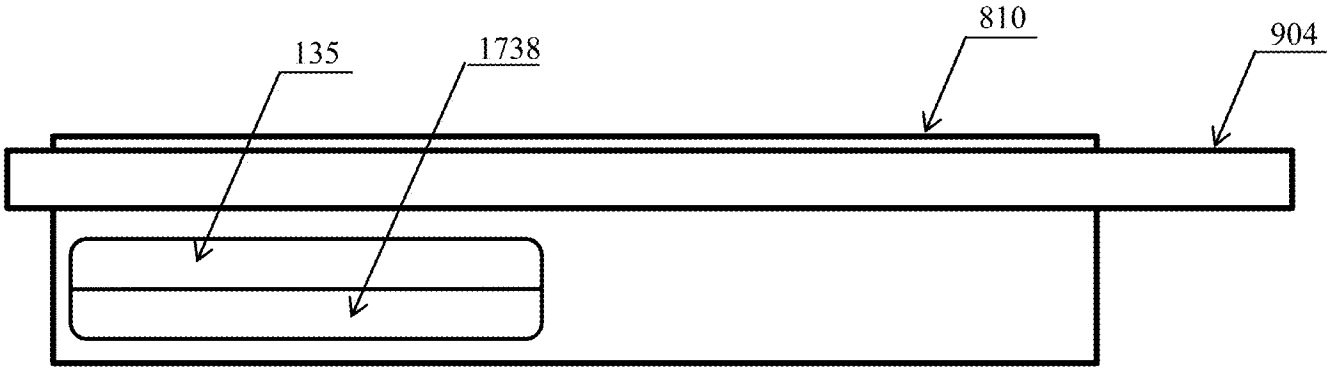
FIG. 17C shows the rear view of an adaptive traffic signal mounted on a cross arm support pole, traffic signal plate with mounted traffic flow sensor system (TFSS) and traffic signal control system (TSCS) in the embodiment.

FIG. 17C shows the rear view of an extended rectangular adaptive traffic signal plate 810 mounted on a cross arm pole 904 with a TFSS 135 and a TSCS 1738 attached. The TFSS 135 is closely coupled or interfaced to the TSCS 1738 and may be located within the same weatherproof enclosure on the rear of the extended rectangular adaptive traffic signal plate 810.

Figure 18:
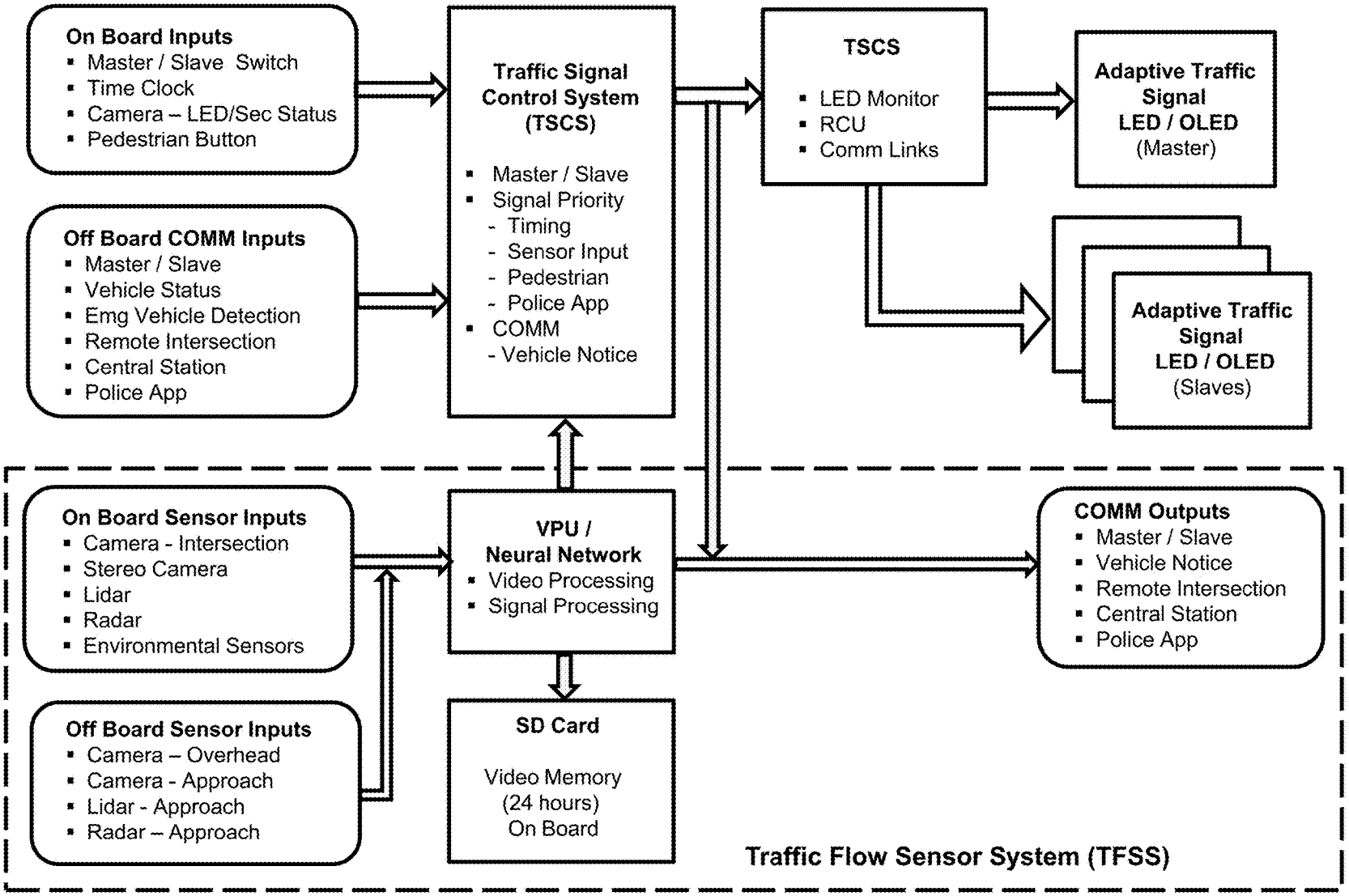
FIG. 18 shows a block diagram of the traffic flow sensor system (TFSS) and traffic signal control system (TSCS) according to another embodiment.

FIG. 18 shows a Block Diagram of the Traffic Flow Sensor System (TFSS) Module and Traffic Signal Control System (TSCS) Module. TFSS & TSCS circuitry and/or modules are closely coupled and may be integrated into the same enclosure, sealed to the environment and attached to rear or back of the Adaptive Traffic Signal. The TFSS implements video & signal processing and algorithms required for traffic flow detection, identification and analysis. The TFSS communicates the results of this analysis to the TSCS with a direct (hard wire) interface or a wireless interface for remotely located TFSSs. The TSCS will then activate the LED/OLED/LEDTV signal lights in the proper sequence and time to maximize traffic flow through intersections. The TSCS consists of a CPU (Central Processing Unit) with an accurate time clock that will determine the time and sequence of LED/OLED/LEDTV signal lights, changing from GREEN to YELLOW to RED, then to GREEN to continue the cycle.

The TSCS includes two independent hardware platforms, each independent hardware platform has a CPU (Central Processing Unit), a real time operating system and a time clock to determine the time and sequence of the LED lights, changing from GREEN to YELLOW to RED, and then to GREEN to continue a cycle. The two independent hardware platforms include a first independent hardware platform working as a main controlling unit and a second independent platform working as a backup control unit; in case of a failure of the first independent hardware platform, the second independent hardware platform starts working as the main control unit and the TSCS will forward a malfunctioning code to the central traffic control monitoring center for resolution.

Remote TFSS to TSCS Communication links capabilities include but are not limited to technologies like Blue Tooth, Zigbee, Z-Wave, LoRa, and Wi-Fi, and are used to communicate with other Adaptive Traffic Signal/Support Pole (local) mounted devices and off pole (remote) devices, other intersection Adaptive Traffic Signals, intersection to intersection communications for signal coordination, intersection to vehicle communication for on-vehicle signal and alert status (especially autonomous or semi-autonomous vehicle systems), intersection to emergency vehicle communications for emergency vehicle priority, intersection and remote TFSS communications to central stations for monitoring and control, and remote control devices and cell phone apps for maintenance personnel and police override traffic control. Specifically, adaptive traffic signal systems can send signals and traffic alert messages to vehicles. The signal can be sent wirelessly to the vehicles heading towards the intersection. Alternatively, the signals and alert messages can be shared on mobile applications. The TSCS activates the adaptive traffic signal LEDs/OLEDs/LEDTVs and/or Pedestrian signals in the proper sequence and time to maximize traffic and pedestrian flow through intersections.

The Vision Processing Unit (VPU)/Neural Network Chip manufactured by INTEL, NVIDIA, QUALCOM, GENERAL VISION and others may be used for processing. INTEL has a VPU chip that features a Neural Compute Engine with 16 core processors each providing the ability to perform separate pipeline algorithms, sensor fusion and/or convolution neural networks all in a low power chip suitable for battery operation. The Neural Compute Engine portion adds hardware accelerators designed to dramatically increase performance of deep neural networks without including the low power characteristics of the chip. Known software and algorithms will be applied to this chip or others to detect, recognize and analyze vehicle presence, number of vehicles, vehicle type, location, speed and expected time to intersection threshold. INTEL and GENERAL VISION both have low power chips that perform RBF (Radial Basis Function) neural networks in real time and can be considered Fast Learning (as opposed to Deep Learning) processors. GENERAL VISIONS's chips have 576 neurons with low power characteristics in a very small package, where each neuron consists of a processor and memory. Neurons can be configured in parallel or hierarchical and suitable for fast or real time learning and provides real time image or signal detection, classification and recognition. These processors (chips) are taught and not necessarily programmed, so programming is simplified and known by technologists in that field.

Figure 19:
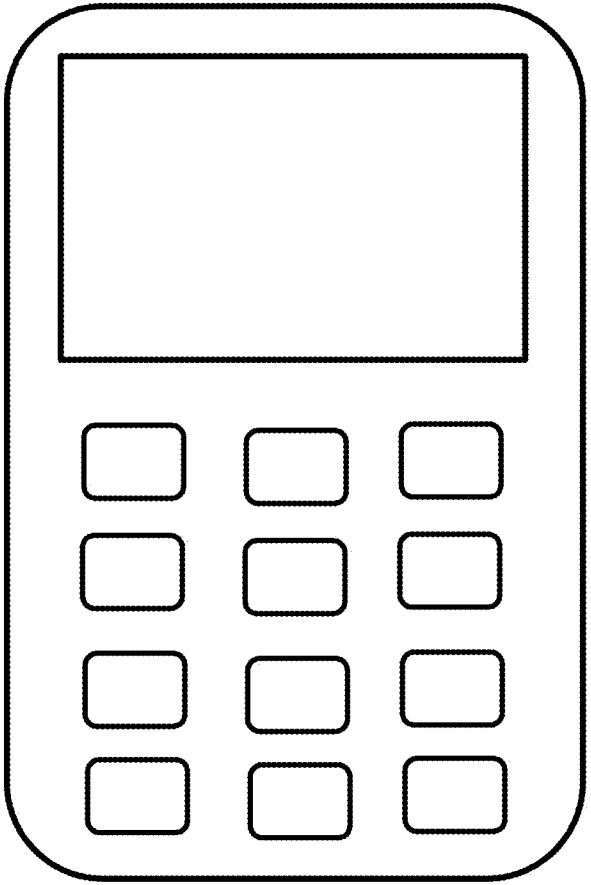
FIG. 19 shows a remote control unit (RCU) according to another embodiment.

FIG. 19 shows a remote-control unit according to another embodiment.

As explained above, the embodiments of the present invention, adaptive traffic signal, uses similar technology as implemented in Autonomous vehicles with very low power components and powered by solar panels and rechargeable batteries. A perfect example of systems implementing small, lightweight, low power and low price (SWAP) technology is technology implemented in consumer drones or unmanned aerial systems (UAS) and cell phones. Coupled with LED/LEDTV/OLED's (Organic Light Emitting Diode) on the front of traffic signals and solar panel/battery packs for power, this combination could substantially reduce operating costs for new and existing traffic signals and increase intersection traffic flow for maximum traffic throughput saving drivers time, fuel and cost while minimizing intersection red light runners and intersection accidents.

Technologies used in consumer Drones today have the ability to observe their surroundings, avoid obstacles, navigate and land autonomously. This is accomplished with Visual (EO) & Infrared (IR) Cameras, Stereo Cameras, Lidar, Radar and Ultrasonic sensors coupled with very robust and compute intensive Signal & Vision Processing Units (VPUs) that provide advanced signal processing, image processing, artificial intelligence (AI) and deep Learning techniques & algorithms. All this computer power is achieved with small, lightweight, low power and low-cost computer chips. A technology that is a perfect fit to detect, recognize and control vehicles, bicycles and pedestrians entering intersections. The invention implements EO/IR cameras, Lidar and/or Radar sensors to detect oncoming vehicles, their speed, heading, location, size and type to include number of vehicles from all directions, analyze this data and control the LED traffic signal lights to produce very efficient intersection traffic flow. These Adaptive Traffic Signals would replace existing Standard Traffic Signals or implemented as new traffic signals on each corner of an intersection.

Typical traffic intersections have four corners and associated traffic signals, although could vary somewhat depending on the intersections. One Adaptive Traffic Signal—Traffic Signal Control System (TSCS) would act as the Master Controller and the other three corners Adaptive Traffic Signals—TSCSs act as Slave Controllers or as backup to the Master Controller in the event of Master TSCS malfunction. They would communicate with one another via RF or Wi-Fi links, very similar to Remote Control drones and model airplanes. Or in another example, concert attendees are given wrist bands or wands prior to entry at concerts where their wrist bands or wands are activated to different color LEDs or flashing LEDs all simultaneously at different times throughout the concert by RF communication, and is very impressive to attendees when all attendees' wrist bands or wands display the same color. In a similar fashion, Adaptive Traffic Signal's—TSCSs would communicate with all other traffic signals mounted locally on the same support pole and associated cross arm support pole via hardwire or wireless links, other intersection direction adaptive traffic signals via hardwire or wireless links, and driver assisted and autonomous vehicles via RF or Wi-Fi Links to provide cues and advise drivers and autonomous vehicles of intersection traffic signal status and when and where to stop. TSCSs would communicate with adjacent intersection traffic control systems via cell phone or longer range RF links to coordinate traffic flow from intersection to intersection to maximize traffic flow. Adaptive Traffic Signals would also communicate with Central Traffic Control Monitoring Centers for status and malfunction resolution, and Police Centers to observe traffic flow and take immediate action upon traffic accidents, situations or events requiring appropriate intervention.

Today's traffic control systems typically consist of a large box mounted in close proximity to one corner of an intersection and includes a multitude of computer boards or modules and typically programmed via Ladder Logic. This box can be very large and the system cost to install can be high, as all intersection traffic signals are wired from this controller via underground wiring to support poles, then to the individual traffic signals. All the capability employed in standard traffic signal control systems today would be implemented in the Adaptive Traffic Signal—Traffic Signal Control System (TSCS), but in a significantly smaller and lower cost package. A package size equivalent to about the size of a pack of cigarettes and located on or in close proximity to the Adaptive traffic Signal being controlled.

Adaptive Traffic Signals could upgrade present Traffic Signals or for new installations, particularly at corners having difficulty justifying the cost associated with present day traffic signal installation.

Adaptive Traffic Signals, sensors and other components located on traffic signal support poles are powered by in ground electric utilities or by "stand alone" solar panels & batteries. Solar Panels/Battery Packs may be located in conjunction with Adaptive Traffic Signals or remotely on traffic signal support poles or elsewhere. To insure reliable system functionality, the Adaptive Traffic Signal incorporates a Signal Light Monitoring System (SLMS or intelligent camera) that continually monitors LED signal & timing status on the front side of the adaptive traffic signal. The SLMS/Camera/Neural Network Module, located on a bracket on the front or the front edge of the Solar Panel/Battery Pack, would have a clear view of the front of the adaptive traffic signal. The SLMS employee neural network technology with the ability to detect and recognize LED signal and timing status and malfunctions. In the event of LED signal or timing malfunction, the SLMS would notify the TSCS and in turn notify a central traffic control monitoring center for resolution and all intersection Adaptive Traffic Signals would be turned "OFF", go into an inactive state and revert to a flashing "Red" signal for all directional stops.

As vehicles approach intersection's Adaptive Traffic Signals, their presence, speed, acceleration or deceleration, heading, location, size and type will be detected by any combination of video cameras, stereo cameras, LIDAR and Radar sensors located on or in close proximity to the Adaptive Traffic Signals. Sensor data will be processed and analyzed by robust signal & Vision Processor Units (VPUs) and Neural Networks (NN) using deep learning and/or fast learning techniques and algorithms to determine timing sequence and to maximize intersection traffic flow efficiency. This technology or module, Traffic Flow Sensor System (TFSS) Module, would be incorporated into the Traffic Signal Control System (TSCS) to provide sensor input control. GREEN Lights may be held "ON" longer to allow fast traveling cars, trucks or buses through the intersection prior to changing signals. They will also be held "ON" until pedestrians or bicyclists have finished crossing intersections. Upon traffic accident or incident detection by separate overhead intersection cameras, Adaptive Traffic Signals will immediately revert to RED Light Status or Stop in all directions until the intersection is cleared.

In another embodiment, the sensor data is processed by a system based on neural network architecture, designed specifically around the Radial Basis Function (RBF) or K Nearest Neighbor modes of operation. An RBF neural network can be considered an expert system, which recognizes and classifies objects or situations and makes instantaneous decisions, based on accumulated knowledge. It accumulates its knowledge 'by example' from data samples and corresponding categories. Its generalization capability allows it to react correctly to objects or situations that were not part of the learning examples. The learning capability of an RBF neural network model is not limited in time, as opposed to some other models. It is capable of additional learning while performing classification tasks. The RBF mode of operation allows for instant "learning on the fly". Tracking a vehicle, for example, an operator can select an object to be tracked by placing a region of interest (ROI) around the object and selecting this region with a mouse click while neural network is in its learning mode, feature extraction algorithms may be applied (neural network can work with raw data or feature extracted data), data from the ROI will be loaded into the memory block automatically and sequentially (requiring from one to a multitude of neurons), thus training neural network from a single frame of imagery and in real time. Once learned, neural network will input the second frame of imagery, compare data from the entire frame with the neuron memory contents, find a match, classify the match, and provide an X-Y (coordinates) position or location output. This X-Y output will allow an associated pan and tilt mechanism to track the object of interest in real time. This process continues for each successive frame. In the event the vehicle turns or changes shape in relation to the camera location, the degraded quality of the neuron memory comparison will trigger the neural network learning mode to capture this changed data and commit more neurons for the new object shape. This neural network will simultaneously and continuously track the object, allowing itself the ability to track even as new patterns are learned.

Artificial Intelligence (AT) solutions today typically require high performance computers and/or parallel processors running AI or neural network software performing "Deep Learning" on back propagation and other neural networks. These systems can be large, consume significant power and be very costly for both the hardware and software. The learning phase for Deep Learning neural networks is generally performed in data centers or the "Cloud" and takes huge computing resources that can take days depending on the data set and number of levels in the network. After the network has been generated it can be downloaded to relatively low power processing systems (Target Systems) in the field. However, these target systems are typically not capable of embedded learning, and generally consist of powerful PCs and GPU (Graphic Processing Unit) acceleration resulting in significant cost and power consumption. Additionally, as the training dataset grows during the learning phase, there is no guarantee that the target hardware will remain sufficient and users may have to upgrade their target systems to execute properly after a new network has been generated during the learning phase. The major limitation to this approach is that new training data cannot be incorporated directly and immediately in the executable knowledge. It often also requires a fair amount of hand coding and tuning to deliver useful performance on the target hardware and is therefore not easily portable. Unlike Deep Learning networks, the neural network based on RBF networks can be easily mapped on hardware because the structure of the network does not change with the learned data. This ability to map the complete network on specialized hardware allows RBF networks to reach unbeatable performances in terms of speed and power dissipation both for learning and recognition. Preferably, the neural network has a NEUROMEM™ architecture.

For traffic flow determination, low and constant latency is a very desirable feature as it guarantees high and predictable results. With Deep Learning, latency varies. Typically, the more the system learns, the slower it becomes. This is due to the Von Neumann architecture bottlenecks found in all computers which run sequential programs. Even the most modern multi-core architectures, even the best GPU or VPU architectures have limitations to their parallelism because some resources (cache, external memory access, bus access, etc.) are shared between the cores and therefore limit their true parallelism. The NEUROMEM™ architecture goes beyond the Von Neumann paradigm and, thanks to its in-memory processing and fully parallel nature does not slow down when the training dataset grows. In fact, any environment which needs on-the-job learning, fast and predictable latency, easy auditing of decisions is likely to be better served by RBF neural networks, rather than by Deep Learning neural networks.

The real advantage for Adaptive Traffic Signals is the ability to increase intersection traffic flow and safety through remote sensors and fusion sensing by implementing known algorithms and artificial intelligence (AI) computing to change traffic signals and eliminate the need for road imbedded sensors and local power, and the ability to reduce installation time and costs and operating costs. Furthermore, the size, shape and illumination of the signal lights provide higher intersection signal light visibility to drivers with the intent of reducing incidences of red light runners and associated accidents, making intersections safer.

The invention described herein is susceptible to variations, modifications and/or additions other than those specifically described, and it is to be understood that the invention includes all such variations, modifications and/or additions which fall within the spirit and scope of the above description.

What is claimed is:

1. An adaptive traffic signal, comprising:

a traffic signal plate, wherein the traffic signal plate is divided into a plurality of sections including a top section having at least one red light indicator, a center section having at least one yellow light indicator, and a bottom section having at least one green light indicator;

a traffic flow sensor system (TFSS) module located on a rear side of the traffic signal plate;

a plurality of sensor holes or ports are provided in the traffic signal plate for sensor detection of the presence of an oncoming vehicle, a speed of the oncoming vehicle, an acceleration or deceleration of the oncoming vehicle, a heading direction of the oncoming vehicle, a location of the oncoming vehicle, a turn signal status of the oncoming vehicle, a type of the oncoming vehicle, a size of the oncoming vehicle and a registration number of the oncoming vehicle in a traffic lane;

a traffic signal control system (TSCS);

wherein, in an active mode, the adaptive traffic signal works as a traffic control signal and the TSCS switches on at least one light indicator selected from the group consisting of the at least one red light indicator, the at least one yellow light indicator and the at least one green light indicator, according to a traffic control signal light schedule;

wherein, in an inactive mode the adaptive traffic signal switches off the at least one light indicator and switches on at least one flashing light indicator;

wherein the TFSS is used to enhance a TSCS traffic control signal light timing and schedule of the adaptive traffic signal;

a light-emitting diode (LED) display affixed to the traffic signal plate such that when the light-emitting diode display is in an active state, the light-emitting diode display works as a traffic control signal light; wherein to display a red light of the traffic control signal corresponding to a stop signal, a top part of the light-emitting diode display covering the top section is activated to display red color, a center part of the light-emitting diode display covering the center section and a bottom part of the light-emitting diode display covering the bottom section are un-activated or activated to display black or gray color; wherein to display a yellow light of the traffic control signal corresponding to a ready to stop signal, the center part of the light-emitting diode display covering the center section is activated to display yellow color, the top part of the light-emitting diode display covering the too section and the bottom part of the light-emitting diode display covering the bottom section are un-activated or activated to display black or gray color; wherein to display a green light of the traffic control signal corresponding to a go signal, the bottom part of the light-emitting diode display covering the bottom section is activated to display green color, the top part of the light-emitting diode display covering the too section and the center part of the light-emitting diode display covering the center section are un-activated or activated to display black or gray color; wherein the light-emitting diode display has narrow angle patterns of light distribution with a concentration of light power directly in a front direction of the adaptive traffic signal, and vary in brightness in accordance with sunlight; wherein the light-emitting diode display is clearly visible from a distance of at least 800 feet; wherein the light-emitting diode display red light, yellow light and green light portions of the light-emitting diode display are circular, square, rectangular or extended rectangular in shade; wherein the light-emitting diode display goes into an inactive state when the adaptive traffic signal is in the inactive mode.

2. The adaptive traffic signal according to claim 1, wherein, in the inactive mode the TSCS switches off the at least one red light indicator, the at least one yellow light indicator, and the at least one green light indicator, and switches on at least one flashing red light indicator.

3. The adaptive traffic signal according to claim 2, wherein in a condition of malfunctioning of the adaptive traffic signal, the TSCS switches the adaptive traffic signal to work in the inactive mode, and transmits a malfunction code to a traffic control signal monitoring center for resolution.

4. The adaptive traffic signal according to claim 3, wherein the at least one red light indicator includes a plurality of red light emitting diode (LED) lights, the at least one yellow light indicator includes a plurality of yellow LED lights and the at least one green light indicator includes a plurality of green LED lights; wherein the plurality of red LED lights, the plurality of yellow LED lights and the plurality of green LED lights are circular, square, rectangular or extended rectangular in shape.

5. The adaptive traffic signal according to claim 1, wherein each light indicator includes a plurality of signal light indicator zones, each signal light indicator zone includes at least one row of LED lights and each row of LED lights includes a plurality of LED lights;

wherein, the each signal light indicator zone is configured to be switched on and off independently from other signal light indicator zones by the TSCS;

wherein, the TSCS receives data from the TFSS and switches on or off the plurality of signal light indicator zones according to time of day or night, weather conditions and/or traffic conditions.

6. The adaptive traffic signal according to claim 5, further comprising an intelligent Signal Light Monitoring System (SLMS) comprising a camera and a processor module mounted above the traffic signal plate to continuously monitor the red LED lights, the yellow LED lights and the green LED lights and the plurality of light indicator zones provided in the top section, the center section and the bottom section respectively for signal lighting malfunction or timing malfunction;

wherein, in case of detecting a lighting malfunction or a timing malfunction, the SLMS sends a malfunctioning signal indicating a condition of malfunctioning of the adaptive traffic signal to the TSCS, and in-turn transmits a malfunction code to a traffic control signal monitoring center for resolution.

7. The adaptive traffic signal according to claim 6, further comprising a support pole and a cross arm pole, wherein the adaptive traffic signal is mounted on the support pole and/or the cross arm pole; wherein an electrical power wiring, a traffic signal control wiring, a sensor wiring and an SLMS wiring are enclosed within the support pole and the cross arm pole.

8. The adaptive traffic signal according to claim 5, wherein the plurality of red LED lights, the plurality of yellow LED lights and the plurality of green LED lights are provided in form of LED light strips with narrow angle patterns of light distribution with a concentration of light power directly in a front direction of the adaptive traffic signal, and vary in brightness in accordance with sunlight; wherein the LED light strips are clearly visible from a distance of at least 800 feet.

9. The adaptive traffic signal according to claim 8, wherein each LED light strip includes a flexible plastic material affixed with LED lights; wherein the flexible plastic material, containing the LED lights are colored or painted to match a traffic signal plate background color; wherein the red LED light strips, the yellow LED light strips and the green LED light strips are provided in circular, square, rectangular or extended rectangular shapes.

10. The adaptive traffic signal according to claim 5, wherein the at least one red light indicator is a red LED light module affixed on the top section, the at least one yellow indicator is a yellow LED light module affixed on the center section, and the at least one green light indicator is a green LED light module affixed on the bottom section; wherein the red LED light module, the yellow LED light module and the green LED light module are circular, square, rectangular or extended rectangular in shape.

11. The adaptive traffic signal according to claim 4, further comprising an Organic light emitting diode (OLED) flat panel display affixed on the traffic signal plate such that when the OLED flat panel display is in an active state, the OLED display works as a traffic control signal light; wherein to display a red light of the traffic control signal corresponding to a stop signal, a top part of the OLED display covering the top section is activated to display red color, a center part of the OLED display covering the center section and a bottom part of the OLED display covering the bottom section are activated to display black or gray color; wherein to display a yellow light of the traffic control signal corresponding to a ready to stop signal, the center part of the OLED display covering the center section is activated to display yellow color, the top part of the OLED display covering the top section and the bottom part of the OLED display covering the bottom section are activated to display black or gray color; wherein to display a green light of the traffic control signal corresponding to a go signal, the bottom part covering the bottom section is activated to display green color, the top part of the OLED display covering the top section and the center part of the OLED display covering the center section are activated to display black or gray color; wherein the OLED flat panel display has narrow angle patterns of light distribution with a concentration of light power directly in a front direction of the adaptive traffic signal, and vary in brightness in accordance with sunlight; wherein the OLED display is clearly visible from a distance of at least 800 feet; wherein the OLED flat panel display goes into an inactive state when the adaptive traffic signal is in the inactive mode.

12. The adaptive traffic signal according to claim 1, further comprising a solar panel installed on a solar panel support plate and attached to and above the traffic signal plate, wherein the solar panel provides an electric power to the adaptive traffic signal.

13. The adaptive traffic signal according to claim 7, further comprising a solar panel installed on the support pole and/or cross arm support pole of the adaptive traffic signal, wherein the solar panel provides an electric power to the adaptive traffic signal.

14. The adaptive traffic signal according to claim 5, wherein the TSCS is attached to a rear of the traffic signal plate and the TSCS activates the plurality of LED lights and the plurality of light indicator zones in a predetermined sequence or phase and time to control traffic flow through an intersection; wherein the TSCS comprises two independent hardware platforms, each independent hardware platform has a CPU (Central Processing Unit) and a time clock to determine the time and sequence of the LED lights, changing from GREEN to YELLOW to RED, and then to GREEN to continue a cycle; wherein the two independent hardware platforms include a first independent hardware platform working as a main controlling unit and a second independent platform working as a backup control unit; in case of a failure of the first independent hardware platform, the second independent hardware platform starts working as the main control unit, and a malfunction signal code is forwarded to a central traffic control monitoring center for resolution.

15. The adaptive traffic signal according to claim 14, wherein the TSCS is configured to communicate with a central traffic network, a central traffic control monitoring center, emergency vehicles, autonomous and semi-autonomous vehicles; wherein the communication is at least one selected from the group consisting of a Bluetooth communication, a LoRa communication, an internet communication, a cell phone network communication, an independent intranet network communication, an RF communication, a wired communication, and an optic fiber communication; wherein, TSCS data and parameters communicated are in a coded format; wherein signal codes communicated to autonomous and semi-autonomous vehicles include a signal light status, a countdown time to signal change, a distance to stop on yellow signal light to prevent red light jumping; wherein, malfunction codes are communicated to central traffic control monitoring centers for resolution.

16. The adaptive traffic signal according to claim 14, wherein, the traffic flow sensor system (TFSS) module is located on the rear of the traffic signal plate in close proximity and integrated into the TSCS to enhance the signal timing by detecting the presence of the oncoming vehicle, the speed of the oncoming vehicle, the acceleration/deceleration of the oncoming vehicle, the heading direction of the oncoming vehicle, the location of the oncoming vehicle, the turn signal status of the oncoming vehicle, the type of the oncoming vehicle, the size of the oncoming vehicle and the number of the oncoming vehicle in a traffic lane; wherein the TFSS module is integrated with the TSCS by hard wire or via a wireless communication link.

17. The adaptive traffic signal according to claim 16, wherein the TFSS module comprises a plurality of sensors including a first EO (visual electro optical) or IR (infrared) camera for detecting vehicle data including the presence of the oncoming vehicle, the location of the oncoming vehicle, the turn signal status of the oncoming vehicle, the type of the oncoming vehicle, the size of the oncoming vehicle and the number of the oncoming vehicle in a traffic lane; wherein the TSCS uses the vehicle data to dynamically control the traffic signal sequence and timing.

18. The adaptive traffic signal according to claim 17, wherein the TFSS module further comprises a second camera, wherein the first camera and the second camera are focused on a same space to provide a three-dimensional sensing of the oncoming vehicle to determine a part of the vehicle data including the speed of the oncoming vehicle, the acceleration/deceleration of the oncoming vehicle, the heading direction of the oncoming vehicle and an estimated time each oncoming vehicle will take to reach the intersection; wherein, the second camera is an EO or an IR camera.

19. The adaptive traffic signal according to claim 16, wherein the TFSS module further comprises a radar for detecting the vehicle data including the presence of the oncoming vehicle, the speed of the oncoming vehicle, the location of the oncoming vehicle, and the estimated time each oncoming vehicle will take to reach the intersection.

20. The adaptive traffic signal according to claim 16, wherein the TFSS module further comprises a lidar for detecting the vehicle data including the presence of the oncoming vehicle, the speed of the oncoming vehicle, the location of the oncoming vehicle, the size of the oncoming vehicle, and the estimated time each oncoming vehicle will take to reach the intersection.

21. The adaptive traffic signal according to claim 16, wherein the TFSS module further comprises environmental sensors to detect a weather condition data including temperature, humidity, wind speed, rain, snow, ice, fog and dust; wherein the TSCS uses the weather condition data in combination with traffic flow data to control the sequence and timing of the plurality of LED lights.

22. The adaptive traffic signal according to claim 7, further comprising a plurality of pedestrian signs provided on sides of the support pole, wherein the TSCS controls the plurality of pedestrian signals in synchronization with the traffic control signal.

23. An intersection traffic control system comprising:

a plurality of adaptive traffic signals installed at an intersection;

wherein, each adaptive traffic signal comprises a traffic signal plate;

the traffic signal plate is divided into a plurality of sections;

each section includes at least one light indicator;

wherein, the each adaptive traffic signal is connected to a traffic signal control system (TSCS);

wherein, in an active mode the each adaptive traffic signal works as a traffic control signal and the TSCS switches on the at least one light indicator according to a traffic control signal schedule, and in an inactive mode the TSCS switches off the at least one light indicator and switches on at least one flashing light indicator;

wherein the TSCS of one of the plurality of adaptive traffic signals works as a master TSCS for the intersection traffic control system and the TSCS of all other of the plurality of adaptive traffic signals work as slave TSCSs for the intersection traffic control system;

wherein the TSCSs includes a Master/Slave switch configured to set the adaptive traffic control system to be selected as the master TSCS or as a slave TSCS for the intersection control system and to control a timing of the at least one light indicators for the plurality of adaptive traffic signals;

wherein each TSCS includes a transmitter and a receiver;

wherein the master TSCS transmits a signal code to implement a change of signal to the slave TSCSs and the slave TSCSs transmits confirmation signal codes to the master TSCS to acknowledge and verify a light change;

the plurality of sections of the traffic signal plate includes a top section, a center section and a bottom section;

a traffic flow sensor system (TFSS) module located on a rear side of the traffic signal plate;

a plurality of sensor holes or ports are provided in the traffic signal plate for sensor detection of the presence of an oncoming vehicle, a speed of the oncoming vehicle, an acceleration or deceleration of the oncoming vehicle, a heading direction of the oncoming vehicle, a location of the oncoming vehicle, a turn signal status of the oncoming vehicle, a type of the oncoming vehicle, a size of the oncoming vehicle and a registration number of the oncoming vehicle in a traffic lane;

wherein the TFSS is used to enhance a TSCS traffic control signal light timing and schedule of the adaptive traffic signals;

a light-emitting diode (LED) display affixed to the traffic signal plate such that when the light-emitting diode display is in an active state, the light-emitting diode display works as a traffic control signal light; wherein to display a red light of the traffic control signal corresponding to a stop signal, a top part of the light-emitting diode display covering the top section is activated to display red color, a center part of the light-emitting diode display covering the center section and a bottom part of the light-emitting diode display covering the bottom section are un-activated or activated to display black or gray color; wherein to display a yellow light of the traffic control signal corresponding to a ready to stop signal, the center part of the light-emitting diode display covering the center section is activated to display yellow color, the top part of the light-emitting diode display covering the too section and the bottom part of the light-emitting diode display covering the bottom section are un-activated or activated to display black or gray color; wherein to display a green light of the traffic control signal corresponding to a go signal, the bottom part of the light-emitting diode display covering the bottom section is activated to display green color, the top part of the light-emitting diode display covering the top section and the center part of the light-emitting diode display covering the center section are un-activated or activated to display black or gray color; wherein the light-emitting diode display has narrow angle patterns of light distribution with a concentration of light power directly in a front direction of the adaptive traffic signal, and vary in brightness in accordance with sunlight; wherein the light-emitting diode display is clearly visible from a distance of at least 800 feet; wherein the light-emitting diode display red light, yellow light and green light portions of the light-emitting diode display are circular, square, rectangular or extended rectangular in shape; wherein the light-emitting diode display goes into an inactive state when the adaptive traffic signal is in the inactive mode.

24. The intersection traffic control system according to claim 23, wherein, in case the master TSCS does not receive the confirmation signal codes from the slave TSCS or receives a slave TSCS malfunction signal code, the master TSCS initiates a shut-down sequence, sending the plurality of adaptive traffic signals to work in the inactive mode and a malfunction signal code is forwarded to a central traffic control monitoring center for resolution.

25. The intersection traffic control system according to claim 23, wherein, the at least one light indicator includes at least one red light indicator, at least one yellow light indicator, and at least one green light indicator; the top section is provided with the at least one red light indicator; the center section is provided with the at least one yellow light indicator; the bottom section is provided with the at least one green light indicator.

26. The intersection traffic control system according to claim 25, wherein the at least one red light indicator includes a plurality of red light emitting diode (LED) lights, the at least one yellow light indicator includes a plurality of yellow LED lights and the at least one green light indicator includes a plurality of green LED lights.

27. The intersection traffic control system according to claim 26, wherein the plurality of red LED lights, the plurality of yellow LED lights and the plurality of green LED lights are provided in form of LED light strips with narrow angle patterns of light distribution with a concentration of light power directly in a front direction of the adaptive traffic signal, and vary in brightness in accordance with sunlight; wherein the LED light strips are clearly visible from a distance of at least 800 feet.

28. The intersection traffic control system according to claim 26, further comprising an Organic light emitting diode (OLED) flat panel display affixed on the traffic signal plate such that when the OLED flat panel display is in an active state, the OLED display works as a traffic control signal light; wherein to display a red light of the traffic control signal corresponding to a stop signal, a top part of the OLED display covering the top section is activated to display red color, a center part of the OLED display covering the center section and a bottom part of the OLED display covering the bottom section are activated to display black or gray color; wherein to display a yellow light of the traffic control signal corresponding to a ready to stop signal, the center part of the OLED display covering the center section is activated to display yellow color, the top part of the OLED display covering the top section and the bottom part of the OLED display covering the bottom section are activated to display black or gray color; wherein to display a green light of the traffic control signal corresponding to a go signal, the bottom part covering the bottom section is activated to display green color, the top part of the OLED display covering the top section and the center part of the OLED display covering the center section are activated to display black or gray color; wherein the OLED flat panel display has narrow angle patterns of light distribution with a concentration of light power directly in a front direction of the adaptive traffic signal, and vary in brightness in accordance with sunlight; wherein the OLED display is clearly visible from a distance of at least 800 feet; wherein the OLED flat panel display goes into an inactive state when the adaptive traffic signal is in the inactive mode.

29. The intersection traffic control system according to claim 26, wherein the TSCS is configured to communicate with other intersections, a central traffic network, a central traffic control monitoring center, emergency vehicles, and autonomous vehicles; wherein the communication is at least one selected from the group consisting of a Bluetooth communication, a LoRa communication, a Wi-Fi communication, a cell phone network communication, an independent intranet network communication, an RF communication, a wired communication, and an optic fiber communication.

30. The intersection traffic control system according to claim 26, further comprising a remote control unit for testing and verifying operations of the intersection control system remotely.

31. The intersection traffic control system according to claim 30, further comprising a remote control unit for manually controlling the signal lights.

* * * * *